US011673766B2

(12) United States Patent
Karve et al.

(10) Patent No.: US 11,673,766 B2
(45) Date of Patent: Jun. 13, 2023

(54) ELEVATOR ANALYTICS FACILITATING PASSENGER DESTINATION PREDICTION AND RESOURCE OPTIMIZATION

(71) Applicant: International Business Machines Corporation, Armonk, NY (US)

(72) Inventors: Gauri Karve, Cohoes, NY (US); Tara Astigarraga, Fairport, NY (US); Eric Miller, Fairfield, CT (US); Kangguo Cheng, Schenectady, NY (US); Fee Li Lie, Albany, NY (US); Sean Teehan, Albany, NY (US); Marc Bergendahl, Rensselaer, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 1263 days.

(21) Appl. No.: 16/173,781

(22) Filed: Oct. 29, 2018

(65) Prior Publication Data

US 2020/0130983 A1 Apr. 30, 2020

(51) Int. Cl.

| | |
|---|---|
| ***B66B 1/46*** | (2006.01) |
| ***B66B 1/24*** | (2006.01) |
| ***B66B 5/00*** | (2006.01) |

(52) U.S. Cl.

CPC ..... *B66B 1/2458* (2013.01); *B66B 1/468* (2013.01); *B66B 5/0012* (2013.01);

(Continued)

(58) Field of Classification Search

CPC . B66B 2201/215; B66B 1/3446; B66B 3/002; B66B 3/02; B66B 1/3415;

(Continued)

(56) References Cited

U.S. PATENT DOCUMENTS 4,838,384 A 6/1989 Thangavelu
5,168,136 A * 12/1992 Thangavelu ..... B66B 1/2466 187/247

(Continued)

FOREIGN PATENT DOCUMENTS

JP 2020019611 A * 2/2020 ..... B66B 1/2433
WO WO-2019015691 A1 * 1/2019 ..... B66B 1/34

OTHER PUBLICATIONS

Smith, et al., ETD Algorithm with Destination Dispatch and Booster Options, https://www.peters-research.com/index.php/support/articles-and-papers/42-etd-algorithm-with-destination-dispatch-and-booster-options, Last Accessed Dec. 5, 2016, 15 Pages.

(Continued)

*Primary Examiner* — Marlon T Fletcher

(74) *Attorney, Agent, or Firm* — Amin, Turocy & Watson, LLP

(57) ABSTRACT

Systems, computer-implemented methods, and computer program products that can facilitate elevator analytics and/or elevator optimization components are provided. According to an embodiment, a system can comprise a memory that stores computer executable components and a processor that executes the computer executable components stored in the memory. The computer executable components can comprise a prediction component that can predict a current destination of an elevator passenger based on historical elevator usage data of the elevator passenger. The computer executable components can further comprise an assignment component that can assign the elevator passenger to an elevator based on the current destination.

20 Claims, 12 Drawing Sheets

(52) U.S. Cl.
CPC ..... *B66B 2201/103* (2013.01); *B66B 2201/20* (2013.01); *B66B 2201/222* (2013.01); *B66B 2201/402* (2013.01); *B66B 2201/403* (2013.01); *B66B 2201/405* (2013.01); *B66B 2201/4615* (2013.01); *B66B 2201/4653* (2013.01); *B66B 2201/4676* (2013.01)

(58) Field of Classification Search
CPC ..... B66B 5/0037; B66B 2201/226; B66B 2201/243; B66B 1/14; B66B 1/34; B66B 2201/225; B66B 2201/212; B66B 2201/401; B66B 2201/463; B66B 3/006; B66B 2201/223; B66B 2201/20; B66B 2201/234; B66B 2201/4669; B66B 1/3492; B66B 1/52; B66B 1/46; B66B 1/468
See application file for complete search history.

(56) References Cited

U.S. PATENT DOCUMENTS

| | | | | |
|---|---|---|---|---|
| 8,020,672 | B2 | 9/2011 | Lin et al. | |
| 8,210,321 | B2 | 7/2012 | Finschi et al. | |
| 9,016,440 | B2 | 4/2015 | Finschi et al. | |
| 9,327,940 | B2 | 5/2016 | Hänninen et al. | |
| 9,896,305 | B2 * | 2/2018 | Blandin | B66B 1/3461 |
| 2015/0329316 | A1 | 11/2015 | Lee | |
| 2016/0090270 | A1 | 3/2016 | Wang | |
| 2019/0002234 | A1 * | 1/2019 | Shinohe | B66B 1/28 |
| 2019/0308844 | A1 * | 10/2019 | Kannan | B66B 1/28 |
| 2020/0031615 | A1 * | 1/2020 | Hsu | B66B 1/3407 |
| 2020/0130983 | A1 * | 4/2020 | Karve | B66B 1/2458 |
| 2020/0130984 | A1 * | 4/2020 | Wang | G05B 13/027 |
| 2020/0207572 | A1 * | 7/2020 | Jarugubilli | B66B 1/3461 |
| 2020/0412743 | A1 * | 12/2020 | Baracaldo Angel | G06N 20/00 |

OTHER PUBLICATIONS

Kaplan, Intelligent elevators answer vertical challenges, https://www.zdnet.com/article/intelligent-elevators-answer-vertical-challenges/, Last Accessed Sep. 13, 2018, 17 Pages.

Mel, et al., The NIST Definition of Cloud Computing, National Institute of Standards and Technology Special Publication 800-145, Sep. 2011, 7 Pages.

* cited by examiner

ELEVATOR ANALYTICS FACILITATING PASSENGER DESTINATION PREDICTION AND RESOURCE OPTIMIZATION

BACKGROUND

The subject disclosure relates to data analytics and optimization systems, and more specifically, to elevator analytics and elevator optimization systems.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, computer-implemented methods, and/or computer program products that facilitate elevator analytics and elevator optimization components are described.

According to an embodiment, a system can comprise a memory that stores computer executable components and a processor that executes the computer executable components stored in the memory. The computer executable components can comprise a prediction component that can predict a current destination of an elevator passenger based on historical elevator usage data of the elevator passenger. The computer executable components can further comprise an assignment component that can assign the elevator passenger to an elevator based on the current destination.

According to another embodiment, a computer-implemented method can comprise predicting, by a system operatively coupled to a processor, a current destination of an elevator passenger based on historical elevator usage data of the elevator passenger. The computer-implemented method can further comprise assigning, by the system, the elevator passenger to an elevator based on the current destination.

According to another embodiment, a computer program product that can facilitate an elevator analytics and/or elevator optimization process is provided. The computer program product can comprise a computer readable storage medium having program instructions embodied therewith, the program instructions can be executable by a processing component to cause the processing component to predict, by the processor, a current destination of an elevator passenger based on historical elevator usage data of the elevator passenger. The program instructions can also cause the processing component to assign, by the processor, the elevator passenger to an elevator based on the current destination.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details. It is noted that the drawings of the present application are provided for illustrative purposes only and, as such, the drawings are not drawn to scale.

Figure 1:
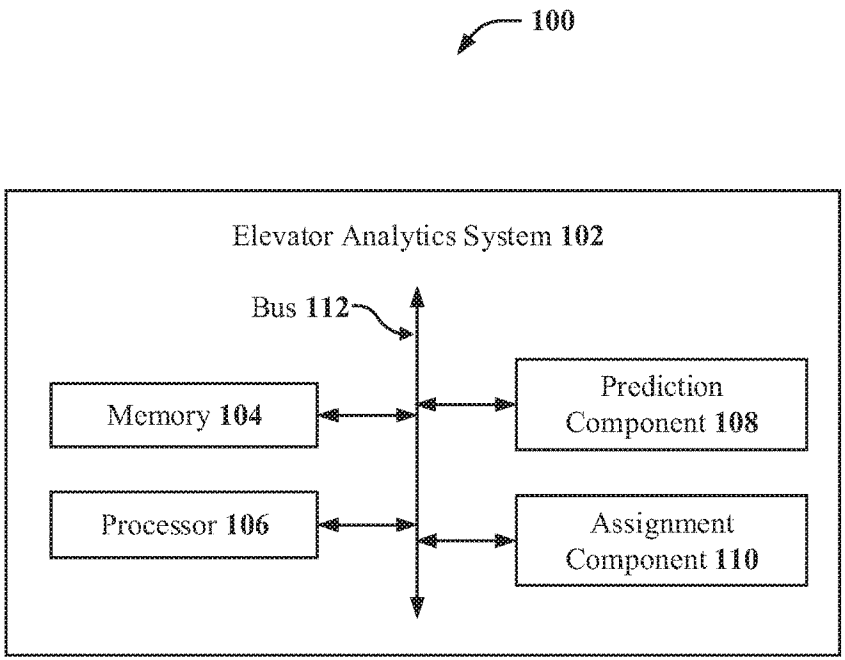
FIG. 1 illustrates a block diagram of an example, non-limiting system that can facilitate elevator analytics and elevator optimization components in accordance with one or more embodiments described herein.

FIG. 1 illustrates a block diagram of an example, non-limiting system 100 that can facilitate elevator analytics and elevator optimization components in accordance with one or more embodiments described herein. In some embodiments, system 100 can comprise an elevator analytics system 102, which can be associated with and/or implemented in a cloud computing environment. For example, elevator analytics system 102 can be associated with and/or implemented in cloud computing environment 1150 described below with reference to FIG. 11 and/or one or more functional abstraction layers described below with reference to FIG. 12 (e.g., hardware and software layer 1260, virtualization layer 1270, management layer 1280, and/or workloads layer 1290).

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Continuing now with FIG. 1, according to several embodiments, system 100 can comprise an elevator analytics system 102. In some embodiments, elevator analytics system 102 can comprise a memory 104, a processor 106, a prediction component 108, an assignment component 110, and/or a bus 112.

It should be appreciated that the embodiments of the subject disclosure depicted in various figures disclosed herein are for illustration only, and as such, the architecture of such embodiments are not limited to the systems, devices, and/or components depicted therein. For example, in some embodiments, system 100 and/or elevator analytics system 102 can further comprise various computer and/or computing-based elements described herein with reference to operating environment 1000 and FIG. 10. In several embodiments, such computer and/or computing-based elements can be used in connection with implementing one or more of the systems, devices, components, and/or computer-implemented operations shown and described in connection with FIG. 1 or other figures disclosed herein.

According to multiple embodiments, memory 104 can store one or more computer and/or machine readable, writable, and/or executable components and/or instructions that, when executed by processor 106, can facilitate performance of operations defined by the executable component(s) and/or instruction(s). For example, memory 104 can store computer and/or machine readable, writable, and/or executable components and/or instructions that, when executed by processor 106, can facilitate execution of the various functions described herein relating to elevator analytics system 102, prediction component 108, assignment component 110, and/or another component associated with elevator analytics system 102, as described herein with or without reference to the various figures of the subject disclosure.

In some embodiments, memory 104 can comprise volatile memory (e.g., random access memory (RAM), static RAM (SRAM), dynamic RAM (DRAM), etc.) and/or non-volatile memory (e.g., read only memory (ROM), programmable ROM (PROM), electrically programmable ROM (EPROM), electrically erasable programmable ROM (EEPROM), etc.) that can employ one or more memory architectures. Further examples of memory 104 are described below with reference to system memory 1016 and FIG. 10. Such examples of memory 104 can be employed to implement any embodiments of the subject disclosure.

According to multiple embodiments, processor 106 can comprise one or more types of processors and/or electronic circuitry that can implement one or more computer and/or machine readable, writable, and/or executable components and/or instructions that can be stored on memory 104. For example, processor 106 can perform various operations that can be specified by such computer and/or machine readable, writable, and/or executable components and/or instructions including, but not limited to, logic, control, input/output (I/O), arithmetic, and/or the like. In some embodiments, processor 106 can comprise one or more central processing unit, multi-core processor, microprocessor, dual microprocessors, microcontroller, System on a Chip (SOC), array processor, vector processor, and/or another type of processor. Further examples of processor 106 are described below with reference to processing unit 1014 and FIG. 10. Such examples of processor 106 can be employed to implement any embodiments of the subject disclosure.

In some embodiments, elevator analytics system 102, memory 104, processor 106, prediction component 108, assignment component 110, and/or another component of elevator analytics system 102 as described herein can be communicatively, electrically, and/or operatively coupled to one another via a bus 112 to perform functions of system 100, elevator analytics system 102, and/or any components coupled therewith. In several embodiments, bus 112 can comprise one or more memory bus, memory controller, peripheral bus, external bus, local bus, and/or another type of bus that can employ various bus architectures. Further examples of bus 112 are described below with reference to system bus 1018 and FIG. 10. Such examples of bus 112 can be employed to implement any embodiments of the subject disclosure.

In some embodiments, elevator analytics system 102 can comprise any type of component, machine, device, facility, apparatus, and/or instrument that comprises a processor and/or can be capable of effective and/or operative communication with a wired and/or wireless network. All such embodiments are envisioned. For example, elevator analytics system 102 can comprise a server device, a computing device, a general-purpose computer, a special-purpose computer, a tablet computing device, a handheld device, a server class computing machine and/or database, a laptop computer, a notebook computer, a desktop computer, a cell phone, a smart phone, a consumer appliance and/or instrumentation, an industrial and/or commercial device, a digital assistant, a multimedia Internet enabled phone, a multimedia players, and/or another type of device.

In some embodiments, elevator analytics system 102 can be coupled (e.g., communicatively, electrically, operatively, etc.) to one or more external systems, sources, and/or devices (e.g., computing devices, communication devices, etc.) via a data cable (e.g., High-Definition Multimedia Interface (HDMI), recommended standard (RS) 232, Ethernet cable, etc.). In some embodiments, elevator analytics system 102 can be coupled (e.g., communicatively, electrically, operatively, etc.) to one or more external systems, sources, and/or devices (e.g., computing devices, communication devices, etc.) via a network.

According to multiple embodiments, such a network can comprise wired and wireless networks, including, but not limited to, a cellular network, a wide area network (WAN) (e.g., the Internet) or a local area network (LAN). For example, elevator analytics system 102 can communicate with one or more external systems, sources, and/or devices, for instance, computing devices (and vice versa) using virtually any desired wired or wireless technology, including but not limited to: wireless fidelity (Wi-Fi), global system for mobile communications (GSM), universal mobile telecommunications system (UMTS), worldwide interoperability for microwave access (WiMAX), enhanced general packet radio service (enhanced GPRS), third generation partnership project (3GPP) long term evolution (LTE), third generation partnership project 2 (3GPP2) ultra mobile broadband (UMB), high speed packet access (HSPA), Zigbee and other 802.XX wireless technologies and/or legacy telecommunication technologies, BLUETOOTH®, Session Initiation Protocol (SIP), ZIGBEE®, RF4CE protocol, WirelessHART protocol, 6LoWPAN (IPv6 over Low power Wireless Area Networks), Z-Wave, an ANT, an ultra-wideband (UWB) standard protocol, and/or other proprietary and non-proprietary communication protocols. In such an example, elevator analytics system 102 can thus include hardware (e.g., a central processing unit (CPU), a transceiver, a decoder), software (e.g., a set of threads, a set of processes, software in execution) or a combination of hardware and software that facilitates communicating information between elevator analytics system 102 and external systems, sources, and/or devices (e.g., computing devices, communication devices, etc.).

According to multiple embodiments, elevator analytics system 102 can comprise one or more computer and/or machine readable, writable, and/or executable components and/or instructions that, when executed by processor 106, can facilitate performance of operations defined by such component(s) and/or instruction(s). Further, in numerous embodiments, any component associated with elevator analytics system 102, as described herein with or without reference to the various figures of the subject disclosure, can comprise one or more computer and/or machine readable, writable, and/or executable components and/or instructions that, when executed by processor 106, can facilitate performance of operations defined by such component(s) and/or instruction(s). For example, prediction component 108, assignment component 110, and/or any other components associated with elevator analytics system 102 as disclosed herein (e.g., communicatively, electronically, and/or operatively coupled with and/or employed by elevator analytics system 102), can comprise such computer and/or machine readable, writable, and/or executable component(s) and/or instruction(s). Consequently, according to numerous embodiments, elevator analytics system 102 and/or any components associated therewith as disclosed herein, can employ processor 106 to execute such computer and/or machine readable, writable, and/or executable component(s) and/or instruction(s) to facilitate performance of one or more operations described herein with reference to elevator analytics system 102 and/or any such components associated therewith.

In some embodiments, to implement one or more elevator analytics operations, elevator analytics system 102 can facilitate performance of operations executed by and/or associated with prediction component 108, assignment component 110, and/or another component associated with elevator analytics system 102 as disclosed herein. For example, as described in detail below, elevator analytics system 102 can facilitate: predicting a current destination of an elevator passenger based on historical elevator usage data of the elevator passenger; assigning the elevator passenger to an elevator based on the current destination; assigning the elevator passenger to the elevator based on an optimal spatial arrangement in the elevator of at least one of one or more elevator passengers and/or one or more objects; determining an optimal spatial arrangement in the elevator of at least one of one or more elevator passengers and/or one or more objects; assigning the elevator passenger to the elevator based on detection of a remote computing device of the elevator passenger; tracking one or more destinations of the elevator passenger to predict a second current destination; allocating one or more elevators based on at least one of the historical elevator usage data, the current destination, current elevator passenger data, and/or an optimal spatial arrangement in the elevator; overriding an assignment of the elevator passenger to the elevator based on at least one of a security rule, an administrative rule, an emergency rule, and/or an identification of a defined second elevator passenger; and/or evaluating status of one or more resources of the system and executing one or more operations to optimize at least one of deployment of one or more elevators or elevator queue duration.

As referenced herein, "elevator passenger" can describe an entity (e.g., a person, an animal, etc.) that has previously ridden an elevator, is currently riding an elevator, and/or is about to ride an elevator (e.g., a person approaching an elevator queue area, a person waiting in an elevator queue area, etc.).

According to multiple embodiments, prediction component 108 can predict a current destination of an elevator passenger based on historical elevator usage data of the elevator passenger. For example, prediction component 108 can predict a current destination of an elevator passenger based on historical elevator usage data that can include, but is not limited to: one or more historical destinations of an elevator passenger; a date and/or time corresponding to such one or more historical destinations of the elevator passenger; whether the elevator passenger was alone or was accompanied by another elevator passenger(s); the identity of such other elevator passenger(s); whether the elevator passenger was transporting an object (e.g., a stroller, luggage, briefcase, etc.); and/or other historical elevator usage data corresponding to the elevator passenger.

In some embodiments, prediction component 108 can compile the historical elevator usage data described above into a historical elevator usage index (e.g., an operational log) that can be stored on a memory device. For example, prediction component 108 can compile such historical elevator usage data into a historical elevator usage index (e.g., an operational log) that can be stored on memory 104 and/or a remote memory device (e.g., a memory device of a remote server).

In some embodiments, such historical elevator usage data can comprise training data that prediction component 108 can input to a machine learning model and/or artificial intelligence model to predict a current destination of the elevator passenger. In some embodiments, prediction component 108 can employ one or more machine learning models and/or artificial intelligence models to predict a current destination of the elevator passenger based on explicit learning and/or implicit learning. For example, prediction component 108 can employ one or more machine learning models and/or artificial intelligence models to predict a current destination of the elevator passenger based on explicit learning, where previously obtained historical elevator usage data corresponding to an elevator passenger can be input to prediction component 108 as training data to train prediction component 108 to predict a current destination of the elevator passenger. In another example, prediction component 108 can employ one or more machine learning models and/or artificial intelligence models to predict a current destination of the elevator passenger based on implicit learning, where prediction component can track (e.g., as described below) the elevator passenger usage of an elevator to train prediction component 108 to predict a current destination of the elevator passenger.

In an embodiment, prediction component 108 can predict a current destination of the elevator passenger based on classifications, correlations, inferences and/or expressions associated with principles of artificial intelligence. For instance, prediction component 108 can employ an automatic classification system and/or an automatic classification process to predict a current destination of the elevator passenger based on the historical elevator usage data corresponding to the elevator passenger. In one embodiment, prediction component 108 can employ a probabilistic and/or statistical-based analysis (e.g., factoring into the analysis utilities and costs) predict a current destination of the elevator passenger based on the historical elevator usage data corresponding to the elevator passenger. In another embodiment, prediction component 108 can include an inference component (not illustrated in FIG. 1) that can further enhance automated aspects of prediction component 108 utilizing in part inference-based schemes to predict a current destination of the elevator passenger based on the historical elevator usage data corresponding to the elevator passenger.

In some embodiments, prediction component 108 can employ any suitable machine learning based techniques, statistical-based techniques, and/or probabilistic-based techniques predict a current destination of the elevator passenger based on the historical elevator usage data corresponding to the elevator passenger. For example, prediction component 108 can employ expert systems, fuzzy logic, SVMs, Hidden Markov Models (HMMs), greedy search algorithms, rule-based systems, Bayesian models (e.g., Bayesian networks), neural networks, other non-linear training techniques, data fusion, utility-based analytical systems, systems employing Bayesian models, and/or another model. In some embodiments, prediction component 108 can perform a set of machine learning computations associated with predicting a current destination of the elevator passenger based on the historical elevator usage data corresponding to the elevator passenger. For example, prediction component 108 can perform a set of clustering machine learning computations, a set of logistic regression machine learning computations, a set of decision tree machine learning computations, a set of random forest machine learning computations, a set of regression tree machine learning computations, a set of least square machine learning computations, a set of instance-based machine learning computations, a set of regression machine learning computations, a set of support vector regression machine learning computations, a set of k-means machine learning computations, a set of spectral clustering machine learning computations, a set of rule learning machine learning computations, a set of Bayesian machine learning computations, a set of deep Boltzmann machine computations, a set of deep belief network computations, and/or a set of different machine learning computations to predict a current destination of the elevator passenger based on the historical elevator usage data corresponding to the elevator passenger.

According to several embodiments, prediction component 108 can track elevator usage data corresponding to an elevator passenger and subsequently utilize such elevator usage data to predict a subsequent destination (e.g., a subsequent current destination) of the elevator passenger at some later time (e.g., at some future time). For example, with every use of an elevator by an elevator passenger, prediction component 108 can track elevator usage data that is the same as (or in some embodiments, different from) the historical elevator usage data described above. For instance, predication component 108 can track one or more destinations of an elevator passenger, a date and/or time corresponding to such one or more destinations, and/or other elevator usage data corresponding to the elevator passenger. In several embodiments, such tracked elevator usage data can constitute historical elevator usage data.

In some embodiments, prediction component 108 can determine a success rate indicative of successful predictions made by prediction component 108 of an elevator passenger's current destination. For example, such a success rate can be determined based on predicted current destinations and the tracked elevator usage data described above. In another example, such a success rate can be determined based on predicted current destinations and actual elevator request data input to elevator analytics system 102 by an elevator passenger (e.g., via elevator kiosk 324*a*, 324*b* and/or remote device 314*a* as described below with reference to FIG. 3). In such embodiments, prediction component 108 can record such success rate in the historical elevator usage index (e.g., operational log) described above and update such index after each prediction based on the predicted current destination and the tracked elevator usage data.

In some embodiments, prediction component 108 can track (e.g., via a network such as, the Internet) a remote device (e.g., a smart phone, a laptop computer, a tablet, a wearable device, etc.) of an elevator passenger to learn one or more destinations the elevator passenger travels to after being assigned to an elevator by assignment component 110 (e.g., as described below). In some embodiments, prediction component 108 can utilize various device tracking applications to track a device of the elevator passenger (e.g., a computing device, a communication device, a radio frequency identification (RFID) tag device, RFID cards, etc.). For example, prediction component 108 can employ a Global Positioning System (GPS) tracking device and/or application to track a mobile computing and/or communication device (e.g., a mobile phone, a tablet, a laptop, a tracking device, a monitoring device, etc.). In another example, prediction component 108 can employ computer tracking software and/or techniques to track a mobile computing device of the elevator passenger over a network (e.g., the Internet) based on an Internet Protocol (IP) address corresponding to such mobile computing device (e.g., a remote computer desktop access application such as, a Virtual Private Network (VPN), etc.).

In some embodiments, elevator analytics system 102 and/or prediction component 108 can facilitate recording the elevator usage data (e.g., one or more destinations of the elevator passenger) learned by predication component 108 (e.g., implicitly via tracking as described above). For example, elevator analytics system 102 and/or prediction component 108 can facilitate recording such elevator usage data in the historical elevator usage index corresponding to the elevator passenger (e.g., as described above).

In some embodiments, prediction component 108 can subsequently utilize such elevator usage data learned by prediction component 108 (e.g., implicitly via tracking as described above) to predict a subsequent destination (e.g., a subsequent current destination) of the elevator passenger at some later time (e.g., at some future time). For example, prediction component 108 can employ one or more machine learning models and/or artificial intelligence models described above and input such elevator usage data into such one or more models to predict a subsequent destination (e.g., subsequent current destination) of the elevator passenger based on the elevator usage data.

In some embodiments, prediction component 108 can utilize historical elevator usage data (e.g., learned explicitly and/or implicitly by prediction component 108 as described above) to predict a current destination of an elevator passenger. For example, based on an elevator passenger's historical elevator usage data, prediction component 108 can determine (e.g., via a machine learning and/or artificial intelligence model described above) that when the elevator passenger approaches an elevator queue area on a weekday at a certain time (e.g., Monday at 7:45 a.m.), such elevator passenger exits the elevator on a certain level of a building (e.g., a level on which the elevator passenger works). In this example, such determination by prediction component 108 can constitute predicting the current destination (e.g., a level on which the elevator passenger works) of the elevator passenger.

In some embodiments, prediction component 108 can employ current visual data of one or more elevator passengers to predict a current destination of a certain elevator passenger. For example, prediction component 108 can employ various video and/or image analytics techniques (e.g., visual analytics techniques) that can utilize such visual data as inputs to identify (e.g., classify) objects in videos and/or images (e.g., videos and/or images that can be captured inside and/or outside an elevator as described below with reference to FIGS. 2 & 3). For instance, prediction component 108 can employ object recognition and/or classification techniques to distinguish animate objects (e.g., people, animals, etc.) from inanimate objects (e.g., a wheelchair, a stroller, luggage, etc.) present in videos and/or images.

In some embodiments, prediction component 108 can employ one or more image analytics techniques (e.g., visual analytics techniques) including, but not limited to, segmentation, object detection, image classification, and/or another image analytics technique to identify (e.g., classify) objects present in videos and/or images. In some embodiments, prediction component 108 can employ one or more feature extraction techniques that employ visual descriptors to identify (e.g., classify) objects present in videos and/or images. For example, prediction component 108 can employ feature extraction techniques including, but not limited to, histogram of oriented gradients (HOG), speeded-up robust features (SURF), local binary patterns (LBP), and/or another feature extraction technique. In some embodiments, prediction component 108 can employ one or more image gradient calculation methodologies (e.g., gradient derivatives) to determine a pixel-by-pixel image gradient corresponding to videos and/or images, which prediction component 108 can use to identify (e.g., classify) objects in such videos and/or images. For example, prediction component 108 can employ image gradient calculation methodologies that utilize gradient derivatives including, but not limited to, Laplacian derivative, Sobel derivative, Scharr derivative, and/or another gradient derivative that can determine a pixel-by-pixel image gradient corresponding to an image.

In some embodiments, based on identifying (e.g., classifying) objects in videos and/or images, prediction component 108 can predict a current destination of an elevator passenger. For example, prediction component 108 can identify an elevator passenger (e.g., via an RFID tag, mobile phone, tablet, etc.) and can further identify luggage carried by the elevator passenger (e.g., via an object recognition and/or classification technique described above). In this example, based on such identification and the elevator passenger's historical elevator usage data, prediction component 108 can determine (e.g., via a machine learning and/or artificial intelligence model described above) that when the elevator passenger is carrying luggage, such elevator passenger exits the elevator on a certain level of a building (e.g., a flight departure level of an airport building). In this example, such determination by prediction component 108 can constitute predicting the current destination (e.g., a flight departure level of an airport building) of the elevator passenger.

According to multiple embodiments, assignment component 110 can assign an elevator passenger to an elevator based on a current destination of the elevator passenger. For example, assignment component 110 can assign an elevator passenger to an elevator based on the current destination of the elevator passenger predicted by prediction component 108 (e.g., as described above). For instance, assignment component 110 can assign an elevator passenger to an elevator that has been provisioned to stop on the same level of a building as that predicted by prediction component 108 to be the current destination of the elevator passenger.

In some embodiments, assignment component 110 can assign an elevator passenger to an elevator based on elevator analytics system 102 and/or components thereof (e.g., prediction component 108, assignment component 110, etc.) detecting the presence of the elevator passenger within a predefined distance from elevator analytics system 102 and/or components thereof (e.g., with a predefined radius). For example, elevator analytics system 102 and/or components thereof (e.g., prediction component 108, assignment component 110, etc.) can detect the presence of the elevator passenger by employing one or more machine vision devices and/or techniques (e.g., via a machine vision camera) that can facilitate identifying (e.g., via video, images, etc.) the elevator passenger in an elevator queue area, in an elevator, and/or another area within a predefined distance from elevator analytics system 102. In another example, elevator analytics system 102 and/or components thereof (e.g., prediction component 108, assignment component 110, etc.) can detect the presence of the elevator passenger by employing one or more voice recognition devices and/or techniques that can facilitate identifying (e.g., via audio data) the elevator passenger in an elevator queue area, in an elevator, and/or another area within a predefined distance from elevator analytics system 102.

In some embodiments, assignment component 110 can assign an elevator passenger to an elevator based on detection of a remote device that can facilitate identification of the elevator passenger via radio frequency signals received from such remote device. For example, elevator analytics system 102 and/or components thereof (e.g., prediction component 108, assignment component 110, etc.), can detect (e.g., within a predefined distance) a remote device including, but not limited to, a smart phone, a laptop computer, a tablet, a wearable device, a site access control device (e.g., a site access badge), an RFID tag device, RFID card, a device having an RFID tag device, and/or another remote device that can facilitate identification of the elevator passenger. For instance, such a remote device can transmit a radio frequency signal that can be received and processed by elevator analytics system 102 and/or components thereof (e.g., prediction component 108, assignment component 110, etc.) to determine the identity of an elevator passenger possessing such a remote device(s).

In some embodiments, detection of the elevator passenger (e.g., via a remote device, machine vision, voice recognition, etc.) can immediately prompt execution of one or more operations of elevator analytics system 102 and/or components thereof (e.g., prediction component 108, assignment component 110, etc.). For example, detection of the elevator passenger (e.g., via a remote device, machine vision, audio recognition, etc.) can immediately prompt prediction component 108 to predict the current destination of the elevator passenger and/or can prompt assignment component 110 to assign the elevator passenger to an elevator based on such detection of the remote device. It should be appreciated that such immediate activation of one or more operations of elevator analytics system 102 and/or components thereof based on detection of an elevator passenger can reduce the amount of time the elevator passenger will wait for an elevator (e.g., can reduce the elevator passenger's queue duration).

In some embodiments, assignment component 110 can assign an elevator passenger to an elevator based on an optimal spatial arrangement in the elevator. For example, assignment component 110 can assign an elevator passenger to an elevator based on an optimal spatial arrangement of one or more elevator passengers and/or one or more objects in the elevator.

In some embodiments, to facilitate assignment of an elevator passenger to an elevator based on an optimal spatial arrangement, assignment component 110 can receive as input an optimal spatial arrangement of one or more elevators. For example, assignment component 110 can receive as input an optimal spatial arrangement of one or more elevators currently transporting one or more elevator passengers and/or one or more objects. In another example, assignment component 110 can receive as input an optimal spatial arrangement of one or more elevators provisioned to transport, but not yet transporting, one or more elevator passengers and/or one or more objects assigned to such an elevator(s). In these examples, such optimal spatial arrangements of such elevators can comprise one or more physical spaces in one or more such elevators that can be occupied by the elevator passenger. In these examples, assignment component 110 can assign the elevator passenger to one or more such elevators and/or one or more certain physical spaces in such elevator(s). In these examples, assignment component 110 can assign the elevator passenger (or group of passengers) to one or more such elevators and/or one or more certain physical spaces in such elevator(s) based on the current destination predicted by prediction component 108 (e.g., as described above) and such an optimal spatial arrangement, which can be determined by arrangement component 202 as described below with reference to FIG. 2.

Figure 2:
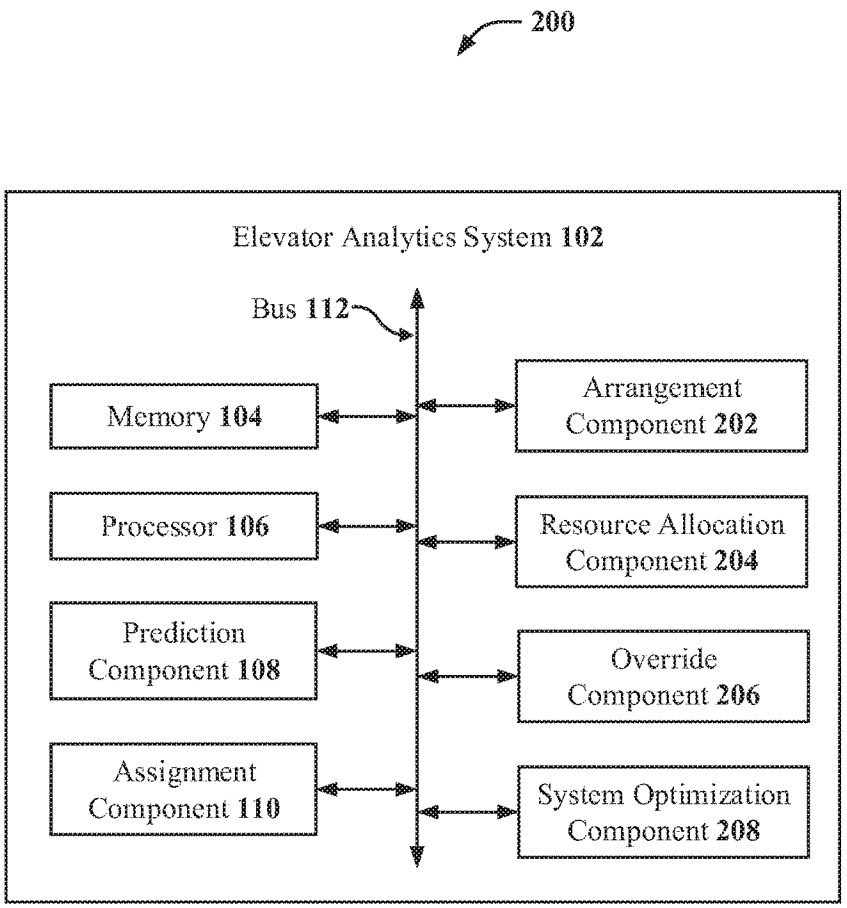
FIG. 2 illustrates a block diagram of an example, non-limiting system that can facilitate elevator analytics and elevator optimization components in accordance with one or more embodiments described herein.

FIG. 2 illustrates a block diagram of an example, non-limiting system 200 that can facilitate elevator analytics and elevator optimization components in accordance with one or more embodiments described herein. In some embodiments, system 200 can comprise elevator analytics system 102. In some embodiments, elevator analytics system 102 can comprise an arrangement component 202, a resource allocation component 204, an override component 206, and/or a system optimization component 208. Repetitive description of like elements and/or processes employed in respective embodiments is omitted for sake of brevity.

According to multiple embodiments, arrangement component 202 can determine an optimal spatial arrangement of one or more elevator passengers and/or one or more objects in an elevator. For example, arrangement component 202 can determine an optimal spatial arrangement of an elevator currently transporting one or more elevator passengers and/or one or more objects. In another example, arrangement component 202 can determine an optimal spatial arrangement of an elevator provisioned to transport, but not yet transporting, one or more elevator passengers and/or one or more objects assigned to such an elevator.

In some embodiments, to facilitate such an optimal spatial arrangement(s), arrangement component 202 can receive as input visual data (e.g., video, images, etc.) of one or more elevator passengers and/or one or more objects located inside an elevator and/or outside an elevator. For example, arrangement component 202 can receive as input video and/or images captured by one or more video recording devices and/or cameras that can be located inside and/or outside one or more elevators (e.g., as described below with reference to FIG. 3). In this example, arrangement component 202 can employ one or more video and/or image analytics techniques (e.g., visual analytics techniques) described above with reference to FIG. 1 to determine whether an elevator passenger is alone or is accompanied by another elevator passenger(s) and/or an object(s) (e.g., a stroller, luggage, wheelchair, etc.).

Additionally or alternatively, in some embodiments, to facilitate such an optimal spatial arrangement(s), arrangement component 202 can receive as input object recognition data determined by prediction component 108 based on visual data (e.g., video, images, etc.) of one or more elevator passengers and/or one or more objects located inside an elevator and/or outside an elevator (e.g., as described above with reference to FIG. 1). In these embodiments, such object recognition data can indicate whether the elevator passenger is alone or is accompanied by another elevator passenger(s) and/or an object(s) (e.g., a stroller, luggage, wheelchair, etc.).

In some embodiments, based on receiving such visual data and/or object recognition data described above, arrangement component 202 can approximate dimensions (e.g., height, width, length) and/or weight of one or more elevator passengers and/or one or more objects located inside and/or outside an elevator. In some embodiments, based on such approximations, arrangement component 202 can employ one or more mathematical calculations and/or one or more algorithms to determine an approximate amount of floor space a certain elevator passenger (or group of elevator passengers) and/or a certain object (or group of objects) will occupy (or is occupying) in an elevator. For example, arrangement component 202 can employ such calculations and/or algorithms to determine an approximate amount of floor space available in a currently occupied elevator and/or a provisioned, but not yet occupied elevator. In this example, arrangement component 202 can also employ such calculations and/or algorithms to determine an approximate amount of floor space a certain elevator passenger (or group of elevator passengers) and/or a certain object (or group of objects) located in an elevator queue area will occupy in such elevator(s).

In some embodiments, to facilitate such an optimal spatial arrangement(s), arrangement component 202 can employ one or more algorithms including, but not limited to, a pixel mapping algorithm, a probability algorithm, a bin packing algorithm (e.g., one-dimensional (1D) bin packing algorithm, two-dimensional (2D) bin packing algorithm, three-dimensional (3D) bin packing algorithm, best-fit algorithm, first-fit algorithm, best-fit decreasing algorithm, first-fit decreasing algorithm, etc.), and/or another algorithm. In these embodiments, by employing one or more of such algorithms (e.g., bin packing algorithms described above), arrangement component 202 can determine an optimal spatial arrangement of one or more elevator passengers and/or one or more objects in one or more elevators simultaneously, thereby optimizing elevator space and operation.

According to multiple embodiments, resource allocation component 204 can allocate (e.g., provision) one or more elevators to transport one or more elevator passengers and/or one or more objects. For example, resource allocation component 204 can allocate (e.g., provision) one or more elevators based on: historical elevator usage data; a current destination of an elevator passenger; current elevator passenger data; and/or an optimal spatial arrangement in the one or more elevators. In some embodiments, elevator analytics system 102 and/or resource allocation component 204 can dispatch one or more elevators based on such allocation of the one or more elevators by resource allocation component 204 (e.g., allocation based on historical elevator usage data, a current destination of an elevator passenger, current elevator passenger data, an optimal spatial arrangement in the one or more elevators, etc.).

In some embodiments, resource allocation component 204 can allocate one or more elevators based on a certain elevator passenger's historical elevator usage data that can be learned by prediction component 108 (e.g., as described above). For example, the elevator passenger's historical elevator usage data can indicate that the elevator passenger is accompanied by a plurality of other elevator passengers when the elevator passenger utilizes the elevator at a certain time on a certain day. In this example, based on such historical elevator usage data, when elevator analytics system 102 detects the identity of the elevator passenger (e.g., via a remote device, machine vision, and/or voice recognition as described above with reference to FIG. 1), resource allocation component 204 can immediately allocate and/or dispatch one or more elevators—having adequate physical space—to collect the elevator passenger and the plurality of other elevator passengers.

In some embodiments, resource allocation component 204 can allocate one or more elevators based on a current destination of an elevator passenger. For example, resource allocation component 204 can allocate one or more elevators based on a current destination of an elevator passenger as predicted by prediction component 108 (e.g., as described above with reference to FIG. 1). In this example, resource allocation component 204 can allocate and/or dispatch one or more elevators provisioned and/or in route to the current destination of the elevator passenger predicted by predication component 108.

In some embodiments, resource allocation component 204 can allocate one or more elevators based on current elevator passenger data. For example, resource allocation component 204 can allocate one or more elevators based on current elevator passenger data comprising visual data (e.g., video, images, etc.) indicating one or more elevator passengers having one or more objects (e.g., stroller, luggage, wheelchair, etc.) are currently waiting in an elevator queue area. In this example, resource allocation component 204 can allocate and/or dispatch one or more elevators—having adequate physical space—to collect such one or more elevator passengers having one or more objects. In some embodiments, resource allocation component 204 can allocate one or more elevators based on current elevator passenger data input to elevator analytics system 102 by an elevator passenger (e.g., via elevator kiosk 324*a*, 324*b* and/or remote device 314*a* as described below with reference to FIG. 3). For example, resource allocation component 204 can allocate one or more elevators based on current elevator passenger data comprising medical and/or health information corresponding to the elevator passenger (and/or another elevator passenger) indicating such elevator passenger has a medical and/or health condition such as, for example, a contagious illness, claustrophobia, and/or another condition. In this example, resource allocation component 204 can allocate and/or dispatch one or more elevators to collect such one or more elevator passengers having such a medical and/or health condition (e.g., an elevator having no other elevator passengers to accommodate an elevator passenger having a contagious illness).

In some embodiments, resource allocation component 204 can allocate one or more elevators based on optimal spatial arrangement in the one or more elevators. For instance, resource allocation component 204 can allocate and/or dispatch one or more elevators based on optimal spatial arrangement of one or more passengers and/or one or more objects in such one or more elevators as determined by arrangement component 202 (e.g., as described above).

According to multiple embodiments, override component 206 can override an assignment of an elevator passenger to an elevator. For example, override component 206 can override an assignment of an elevator passenger to an elevator based on: a security rule; an administrative rule; a medical rule (e.g., a medically guided rule provided by, for example, a physician, a psychologist, or another medically trained professional); an emergency rule; and/or an identification of a defined elevator passenger.

In some embodiments, elevator analytics system 102 and/or override component 206 can be integrated into a security system of a building. For example, elevator analytics system 102 and/or override component 206 can be coupled (e.g., communicatively, electrical, operatively, etc.) to one or more components of a building security system such that utilization (e.g., activation) of one or more of such components can prompt utilization (e.g., activation) of elevator analytics system 102 and/or components thereof. For instance, elevator analytics system 102 and/or override component 206 can be integrated into one or more building security system components including, but not limited to, security cameras, access control devices, and/or another security system component. In such embodiments, override component 206 can override an assignment of an elevator passenger to an elevator based on one or more security rules (e.g., protocols) such as, for example, a security rule that prompts deactivating one or more elevators in the building in the event of a security breach (e.g., breach of an access control system). In such embodiments, in the event of a security breach, for example, override component 206 can override an assignment of an elevator passenger to an elevator based on one or more such security rules.

In some embodiments, elevator analytics system 102 and/or override component 206 can be integrated into an administrative system of a building. For example, elevator analytics system 102 and/or override component 206 can be coupled (e.g., communicatively, electrical, operatively, etc.) to one or more components of a building administrative system such that utilization (e.g., activation) of one or more of such components can prompt utilization (e.g., activation) of elevator analytics system 102 and/or components thereof. For instance, elevator analytics system 102 and/or override component 206 can be integrated into one or more building administrative system components including, but not limited to, communication network components, general purpose computers, special purpose computers, and/or another administrative system component. In such embodiments, override component 206 can override an assignment of an elevator passenger to an elevator based on one or more administrative rules (e.g., directives, notifications, protocols, etc.) such as, for example, an administrative rule that grants premium service (e.g., priority elevator access) to certain pre-defined entities (e.g., company executive, a guest classified as a very important person (VIP), potential customer, etc.). In such embodiments, when such an administrative rule is implemented, elevator analytics system 102 and/or override component 206 can override an assignment of an elevator passenger to an elevator based on one or more such administrative rules granting premium service to such pre-defined entities. For example, when such an administrative rule is implemented, and elevator analytics system 102 and/or components thereof identify one or more of such pre-defined entities (e.g., via a remote device, machine vision, voice recognition, etc.), elevator analytics system 102 and/or override component 206 can override an assignment of an elevator passenger to an elevator in favor of assigning such one or more pre-defined entities to the elevator.

In some embodiments, override component 206 can override an assignment of an elevator passenger to an elevator based on one or more medical rules (e.g., a medically guided rule provided by, for instance, a physician, a psychologist, or another medically trained professional). For example, override component 206 can override an assignment of an elevator passenger to an elevator based on such a medical rule (e.g., protocol) that prompts allocating and/or dispatching an empty elevator to collect an elevator passenger having a contagious illness. For instance, an elevator passenger can input to elevator analytics system 102 (e.g., via elevator kiosk 324*a*, 324*b* and/or remote device 314*a* as described below with reference to FIG. 3) current elevator passenger data indicative of the medical and/or health status of the elevator passenger and/or another elevator passenger (e.g., elevator passenger has a contagious illness, is claustrophobic, etc.). In this example, based on such a medical rule (e.g., protocol) and the current elevator passenger medical and/or health data input to elevator analytics system 102, override component 206 can, for example: override a previous assignment of the elevator passenger to an elevator; and/or override an assignment of a first elevator passenger in favor of a contagiously ill elevator passenger.

In some embodiments, elevator analytics system 102 and/or override component 206 can be integrated into an emergency system of a building. For example, elevator analytics system 102 and/or override component 206 can be coupled (e.g., communicatively, electrical, operatively, etc.) to one or more components of a building emergency system such that utilization (e.g., activation) of one or more of such components can prompt utilization (e.g., activation) of elevator analytics system 102 and/or components thereof. For instance, elevator analytics system 102 and/or override component 206 can be integrated into one or more building emergency system components including, but not limited to, fire and/or smoke alarm system components, emergency first responder call system components, and/or another emergency system component. In such embodiments, override component 206 can override an assignment of an elevator passenger to an elevator based on one or more emergency rules (e.g., protocols) such as, for example, an emergency rule that prompts deactivating one or more elevators in the building in the event of an emergency. In such embodiments, in the event of an emergency, for example, override component 206 can override an assignment of an elevator passenger to an elevator based on one or more such emergency rules.

In some embodiments, override component 206 can override an assignment of an elevator passenger to an elevator based on direct input from the elevator passenger. For example, override component 206 can override (e.g., cancel) an assignment of the elevator passenger to an elevator based on direct input received (e.g., via a graphical user interface (GUI) of elevator analytics system 102) from the elevator passenger utilizing a local device (e.g., an elevator kiosk) communicatively coupled (e.g., via a wired connection) to elevator analytics system 102. In another example, override component 206 can override (e.g., cancel) an assignment of the elevator passenger to an elevator based on direct input received (e.g., via a graphical user interface (GUI) of elevator analytics system 102) from the elevator passenger utilizing a remote device (e.g., a mobile phone, laptop computer, wearable device, etc.) communicatively coupled (e.g., via a wireless connection) to elevator analytics system 102. In these examples, based on such an override prompted by direct input received from the elevator passenger, assignment component 110 can assign the elevator passenger to another elevator. For instance, when the elevator passenger wants to choose a destination that is different from the current destination predicted by prediction component 108 (e.g., as described above with reference to FIG. 1), the elevator passenger can input such a destination into elevator analytics system 102 (e.g., via a GUI on a local device and/or a remote device communicatively connected to elevator analytics system 102). In this example, override component 206 can override (e.g., cancel) an elevator assignment that was output by assignment component 110 based on the predicted current destination, and assignment component 110 can reassign the elevator passenger to another elevator based on the destination input by the elevator passenger.

According to multiple embodiments, system optimization component 208 can evaluate status of one or more resources of elevator analytics system 102 and execute one or more operations to optimize deployment of one or more elevators and/or elevator queue duration. For example, system optimization component 208 can evaluate status of one or more resources of elevator analytics system 102 including, but not limited to, one or more elevators of elevator analytics system 102, one or more components of elevator analytics system 102 (e.g., prediction component 108, assignment component 110, arrangement component 202, resource allocation component 204, override component 206, etc.), and/or another resource of elevator analytics system 102.

In some embodiments, system optimization component 208 can evaluate status of one or more operations of prediction component 108, assignment component 110, arrangement component 202, and/or resource allocation component 204 to ensure wait time of an elevator passenger (e.g., queue duration) is not longer than a defined time. For example, system optimization component 208 can log arrival time of an elevator passenger waiting in an elevator queue area. For instance, system optimization component 208 can log a time at which elevator analytics system 102 detected the presence of the elevator passenger, where system optimization component 208 can log such arrival and/or detection time by recording such time(s) in a historical elevator usage index stored on memory 104 (e.g., as described above with reference to FIG. 1). In this example, based on such arrival and/or detection time, system optimization component 208 can determine whether the wait time (e.g., queue duration) of the elevator passenger is currently longer than a pre-defined time (e.g., 1 minute, 2 minutes, etc.) and if so, system optimization component 208 can facilitate immediate reassignment of the elevator passenger to another elevator by employing (e.g., as needed) override component 206, assignment component 110, arrangement component 202, and/or resource allocation component 204.

In some embodiments, system optimization component 208 can evaluate status of one or more operations of prediction component 108, assignment component 110, arrangement component 202, and/or resource allocation component 204 to optimize deployment of one or more elevators. For example, if elevator analytics system 102 detects the arrival of one or more elevator passengers after a certain elevator has been provisioned to transport, but has not yet transported, other elevator passengers, system optimization component 208 can immediately employ arrangement component 202 to reevaluate the optical spatial arrangement of such provisioned elevator to determine whether such one or more elevator passengers that recently arrived can be assigned to the provisioned elevator. In this example, if arrangement component 202 determines that such one or more elevator passengers having recently arrived can be assigned to the provisioned elevator, system optimization component 208 can facilitate assignment of such one or more elevator passengers to the provisioned elevator by employing (e.g., as needed) override component 206, assignment component 110, arrangement component 202, and/or resource allocation component 204.

Figure 3:
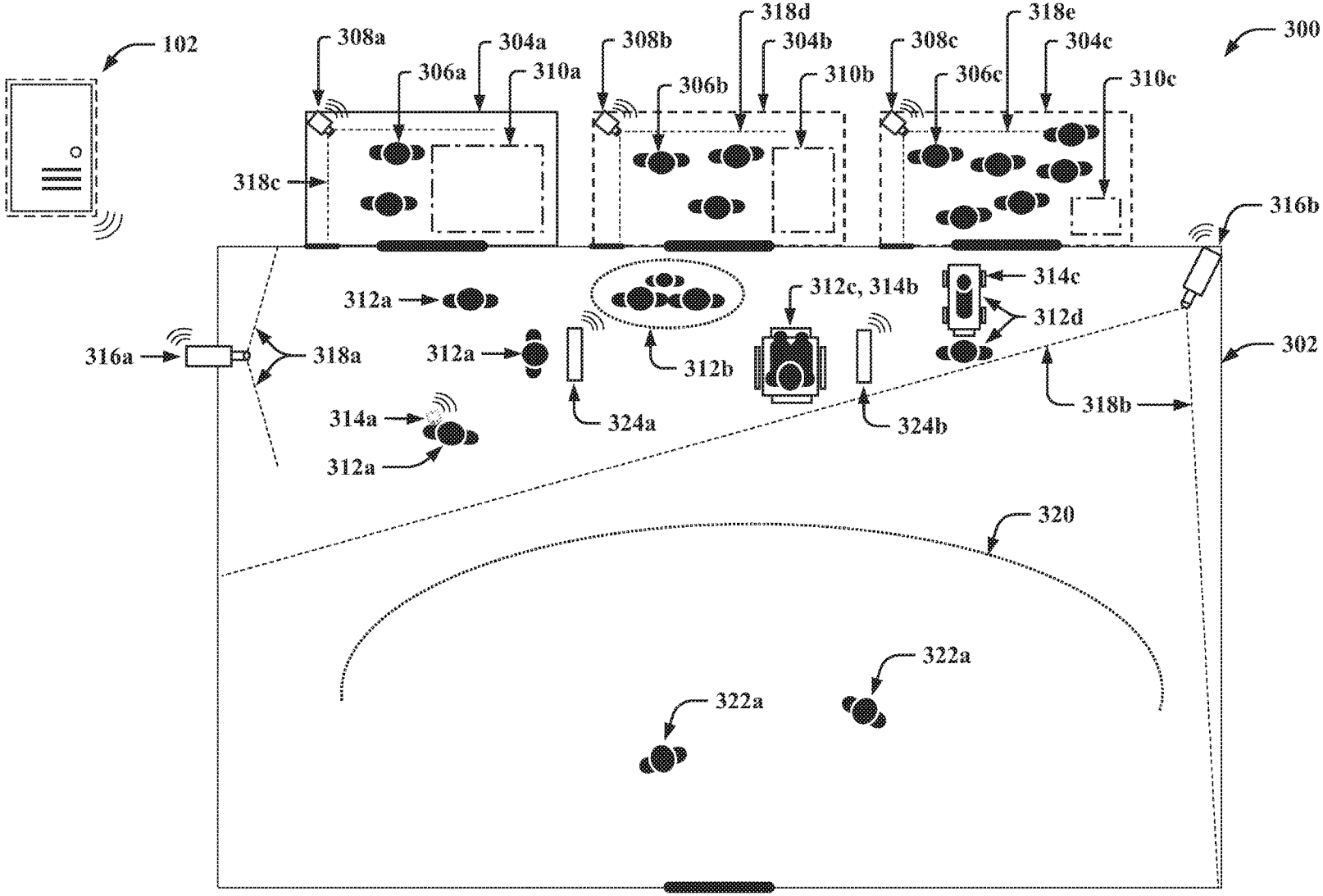
FIG. 3 illustrates a top view of a block diagram of an example, non-limiting system that can facilitate elevator analytics and elevator optimization components in accordance with one or more embodiments described herein.

FIG. 3 illustrates a top view of a block diagram of an example, non-limiting system 300 that can facilitate elevator analytics and elevator optimization components in accordance with one or more embodiments described herein. Repetitive description of like elements and/or processes employed in respective embodiments is omitted for sake of brevity.

In some embodiments, system 300 can comprise elevator analytics system 102, an elevator queue area 302, and/or one or more elevators 304*a*, 304*b*, 304*c*. In some embodiments, system 300 can comprise an environment in which the subject disclosure can be implemented in accordance with one or more embodiments described herein. For example, system 300 can comprise a level (e.g., a story, a floor, etc.) of a building in which elevator analytics system 102 and/or components thereof can be implemented in accordance with one or more embodiments described herein.

In some embodiments, elevators 304*a*, 304*b*, 304*c* can comprise one or more elevator passengers 306*a*, 306*b*, 306*c*, one or more elevator cameras 308*a*, 308*b*, 308*c*, and/or one or more available physical spaces 310*a*, 310*b*, 310*c*. In some embodiments, elevator cameras 308*a*, 308*b*, 308*c* can be located at one or more locations in elevators 304*a*, 304*b*, 304*c*, respectively, such that elevator cameras 308*a*, 308*b*, 308*c* can capture video and/or images of one or more field of view zones 318*c*, 318*d*, 318*e*, respectively (e.g., as illustrated in FIG. 3). In some embodiments, available physical spaces 310*a*, 310*b*, 310*c* can comprise physical spaces that can be determined by arrangement component 202 as being physical spaces that can be occupied by one or more elevator passengers 306*a*, 306*b*, 306*c*, elevator passengers 312*a*, 312*b*, 312*c*, 312*d*, potential elevator passengers 322*a*, 322*b*, and/or objects such as, for example remote device 314*a* and/or wheelchair 314*b* (e.g., as described above with reference to FIG. 2).

In some embodiments, elevators 304*a*, 304*b*, 304*c* can be static (e.g., stopped to on-board and/or off-board elevator passengers) at a level on which elevator queue area 302 is located (e.g., elevator 304*a* depicted in FIG. 3 with a solid line). In some embodiments, elevators 304*a*, 304*b*, 304*c* can be dynamic, for example, moving between levels of a building (e.g., elevators 304*b*, 304*c* depicted in FIG. 3 with dashed lines).

In some embodiments, elevator queue area 302 can comprise one or more elevator passengers 312*a*, 312*b*, 312*c*, 312*d* and/or one or more objects such as for example a remote device 314*a*, a wheelchair 314*b*, and/or a stroller 314*c*, where such elevator passengers 312*a*, 312*b*, 312*c*, 312*d* can comprise a single elevator passenger (e.g., elevator passenger 312*a*, elevator passenger 312*c*, etc.) or one or more groups of elevator passengers (e.g., elevator passengers 312*b*, elevator passengers 312*d*, etc.). In some embodiments, elevator passengers 312*a*, 312*b*, 312*c*, 312*d* can be accompanied by one or more objects, which can include, but are not limited to, a remote device 314*a* (e.g., any remote device described above with reference to FIGS. 1 & 2), a wheelchair 314*b*, a stroller 314*c*, and/or another object.

In some embodiments, elevator queue area 302 can comprise one or more elevator queue area cameras 316*a*, 316*b* that can be located at one or more locations in elevator queue area 302 such that elevator queue area cameras 316*a*, 316*b* can capture video and/or images of one or more field of view zones 318*a*, 318*b* (e.g., as illustrated in FIG. 3). In some embodiments, field of view zones 318*a*, 318*b* can capture video and/or images of one or more elevator queue area perimeter zones 320, which can comprise one or more potential elevator passengers 322*a*, 322*b*.

In some embodiments, elevator queue area 302 can comprise one or more elevator kiosk 324*a*, 324*b*. In some embodiments, elevator kiosk 324*a*, 324*b* can comprise an input and/or output device that can facilitate receiving input data from an entity, displaying output data, and/or communicating with elevator analytics system 102. For instance, elevator kiosk 324*a*, 324*b* can comprise an input and output computing device (e.g., a touch screen computing device) that can facilitate: receiving an elevator request (e.g., via a GUI) from elevator passengers 306*a*, 306*b*, 306*c*; rendering output data (e.g., elevator assignment, wait time, destination, etc.) on a screen of the device (e.g., a monitor); and/or communicating with elevator analytics system 102 (e.g., via a wired connection and/or wireless connection using a network such as, the Internet).

In some embodiments, elevator cameras 308*a*, 308*b*, 308*c* and/or elevator queue area cameras 316*a*, 316*b* can capture visual data (e.g., video, images, etc.) of elevator passengers 306*a*, 306*b*, 306*c*, elevator passengers 312*a*, 312*b*, 312*c*, 312*d*, and/or potential elevator passengers 322*a*, 322*b*, which can be used as input to elevator analytics system 102 to facilitate execution of one or more operations of elevator analytics system 102 and/or components thereof. In some embodiments, elevator cameras 308*a*, 308*b*, 308*c* and/or elevator queue area cameras 316*a*, 316*b* can transmit such visual data to elevator analytics system 102 utilizing a wired and/or wireless connection (e.g., via a wireless network such as, for example, the Internet).

In some embodiments, elevator cameras 308*a*, 308*b*, 308*c* and/or elevator queue area cameras 316*a*, 316*b* can comprise cameras that can facilitate machine vision techniques (e.g., machine vision cameras) to determine identification of elevator passengers 306*a*, 306*b*, 306*c*, elevator passengers 312*a*, 312*b*, 312*c*, 312*d*, and/or potential elevator passengers 322*a*, 322*b* (e.g., as described above with reference to FIG. 1). In this example, such identification can be used as input to prediction component 108, arrangement component 202, resource allocation component 204, override component 206, and/or system optimization component 208 to facilitate execution of one or more operations of such components (e.g., as described above with reference to FIGS. 1 & 2).

In some embodiments, elevator cameras 308*a*, 308*b*, 308*c* and/or elevator queue area cameras 316*a*, 316*b* can capture visual data that can facilitate approximation (e.g., by arrangement component 202 as described above with reference to FIG. 2) of weight of elevator passengers 306*a*, 306*b*, 306*c*, elevator passengers 312*a*, 312*b*, 312*c*, 312*d*, and/or potential elevator passengers 322*a*, 322*b*. In these embodiments, such weight approximation can be utilized by arrangement component 202 to, for instance, to determine an optimal spatial arrangement of one or more elevators 304*a*, 304*b*, 304*c* based on an approximate load (e.g., weight) such elevator(s) will transport. For example, arrangement component 202 can determine a certain spatial arrangement is optimal based on, for instance, size and/or shape of elevator passengers and/or objects; however, if such spatial arrangement exceeds a pre-defined elevator weight and/or load capacity, then arrangement component 202 can determine that such spatial arrangement is not an optimal spatial arrangement. Similarly, in some embodiments, based on such weight and/or load approximation, system optimization component 208 can determine a certain spatial arrangement of elevator passengers and/or objects exceeds a pre-defined optimal weight and/or load value that facilitates optimal energy efficiency by one or more elevators 304*a*, 304*b*, 304*c*. In such embodiments, system optimization component 208 can execute one or more operations to optimize energy efficiency of such one or more elevators. For example, system optimization component 208 can employ assignment component 110, arrangement component 202, resource allocation component 204, and/or override component 206 to, for instance, reassign one or more elevator passengers and/or objects of a certain elevator to another elevator.

In some embodiments, based on identification of one or more potential elevator passengers 322*a*, 322*b* (e.g., by elevator analytics system 102 and/or components thereof utilizing visual data captured by elevator queue area cameras 316*a*, 316*b*), elevator analytics system 102 can facilitate rendering a certain image and/or message on a screen of elevator kiosk 324*a*, 324*b* (e.g., a welcome page and/or message, an advertisement, a tutorial of elevator analytics system 102, etc.). In these embodiments, such an image and/or message can serve to encourage potential elevator passengers 322*a*, 322*b* to engage elevator analytics system 102 and/or explore one or more other levels of a building in which elevator analytics system 102 is implemented. In some embodiments, based on such identification of one or more potential elevator passengers 322*a*, 322*b* (e.g., via visual data captured by elevator queue area cameras 316*a*, 316*b*), elevator analytics system 102 can facilitate dispatching (e.g., via resource allocation component 204) one or more elevators 304*a*, 304*b*, 304*c* to elevator queue area 302 to encourage potential elevator passengers 322*a*, 322*b* to explore one or more other levels of a building in which elevator analytics system 102 is implemented.

In some embodiments, elevator analytics system 102 can be an elevator analytics system and/or elevator optimization system and/or process associated with various technologies. For example, elevator analytics system 102 can be associated with elevator analytics technologies, optimization technologies, elevator optimization technologies, data analytics technologies, cloud computing technologies, computer technologies, server technologies, machine vision technologies, machine learning technologies, artificial intelligence technologies, digital technologies, device tracking technologies, system integration technologies, administrative system technologies, security system technologies, emergency system technologies, and/or other technologies.

In some embodiments, elevator analytics system 102 can provide technical improvements to systems, devices, components, operational steps, and/or processing steps associated with the various technologies identified above. For example, elevator analytics system 102 can predict a current destination of an elevator passenger before such passenger inputs an elevator request into the system (e.g., via prediction component 108), thereby facilitating a smart (e.g., intelligent) elevator system that can reduce queue duration (e.g., wait time) of an elevator passenger. In another example, elevator analytics system 102 can optimize usage of a plurality of elevators simultaneously to optimize energy efficiency of such elevators and/or reduce queue duration (e.g., wait time) of one or more elevator passengers (e.g., via arrangement component 202, system optimization component 208, etc.).

In some embodiments, elevator analytics system 102 can also provide technical improvements to an elevator analytics system and/or elevator optimization system by improving processing performance, processing efficiency, energy efficiency, and/or reducing operation time (e.g., via reducing number of operation cycles) of one or more resources of such system(s). In some embodiments, to facilitate such improvements, elevator analytics system 102 and/or components thereof (e.g., arrangement component 202, system optimization component 208, etc.), can optimize operation of one or more elevators, which can reduce the number of times a certain elevator travels from one level of a building to another within a certain period of time. In these embodiments, such optimized use of one or more elevators can reduce the aggregate amount of time that any one or all such elevators are in use, which can reduce processing time required by a processor associated with the system and/or energy used by the system, thereby improving processing performance, processing efficiency, and/or energy efficiency.

In some embodiments, elevator analytics system 102 can provide technical improvements to a processing unit (e.g., processor 106) associated with one or more resources of an elevator analytics system and/or elevator optimization system. For example, as described above, by optimizing operation of one or more elevators, elevator analytics system 102 can facilitate improving processing performance and/or processing efficiency by reducing the number of processing cycles and/or an aggregate amount of processing time of such processing unit (e.g., processor 106).

In some embodiments, elevator analytics system 102 can employ hardware and/or software to solve problems that are highly technical in nature, that are not abstract and that cannot be performed as a set of mental acts by a human. In some embodiments, some of the processes described herein may be performed by one or more specialized computers (e.g., one or more specialized processing units, a specialized computer with an elevator analytics and/or elevator optimization component(s), etc.) for carrying out defined tasks related to elevator analytics, elevator optimization, machine learning, and/or artificial intelligence. In some embodiments, elevator analytics system 102 and/or components thereof, can be employed to solve new problems that arise through advancements in technologies mentioned above, employment of cloud-computing systems, computer architecture, and/or another technology.

It is to be appreciated that elevator analytics system 102 can perform an elevator analytics and/or elevator optimization process utilizing various combinations of electrical components, mechanical components, and circuitry that cannot be replicated in the mind of a human or performed by a human. For example, predicting a current destination of a plurality of elevator passengers simultaneously and/or simultaneously determining an optimal spatial arrangement of each of such elevator passengers inside each of such elevators, are operations that are greater than the capability of a human mind. For instance, the amount of data processed, the speed of processing such data, and/or the types of data processed by elevator analytics system 102 over a certain period of time can be greater, faster, and/or different than the amount, speed, and/or data type that can be processed by a human mind over the same period of time.

According to several embodiments, elevator analytics system 102 can also be fully operational towards performing one or more other functions (e.g., fully powered on, fully executed, etc.) while also performing the above-referenced elevator analytics and/or elevator optimization process. It should be appreciated that such simultaneous multi-operational execution is beyond the capability of a human mind. It should also be appreciated that elevator analytics system 102 can include information that is impossible to obtain manually by an entity, such as a human user. For example, the type, amount, and/or variety of information included in prediction component 108, assignment component 110, arrangement component 202, resource allocation component 204, override component 206, and/or system optimization component 208 can be more complex than information obtained manually by a human user.

Figure 4:
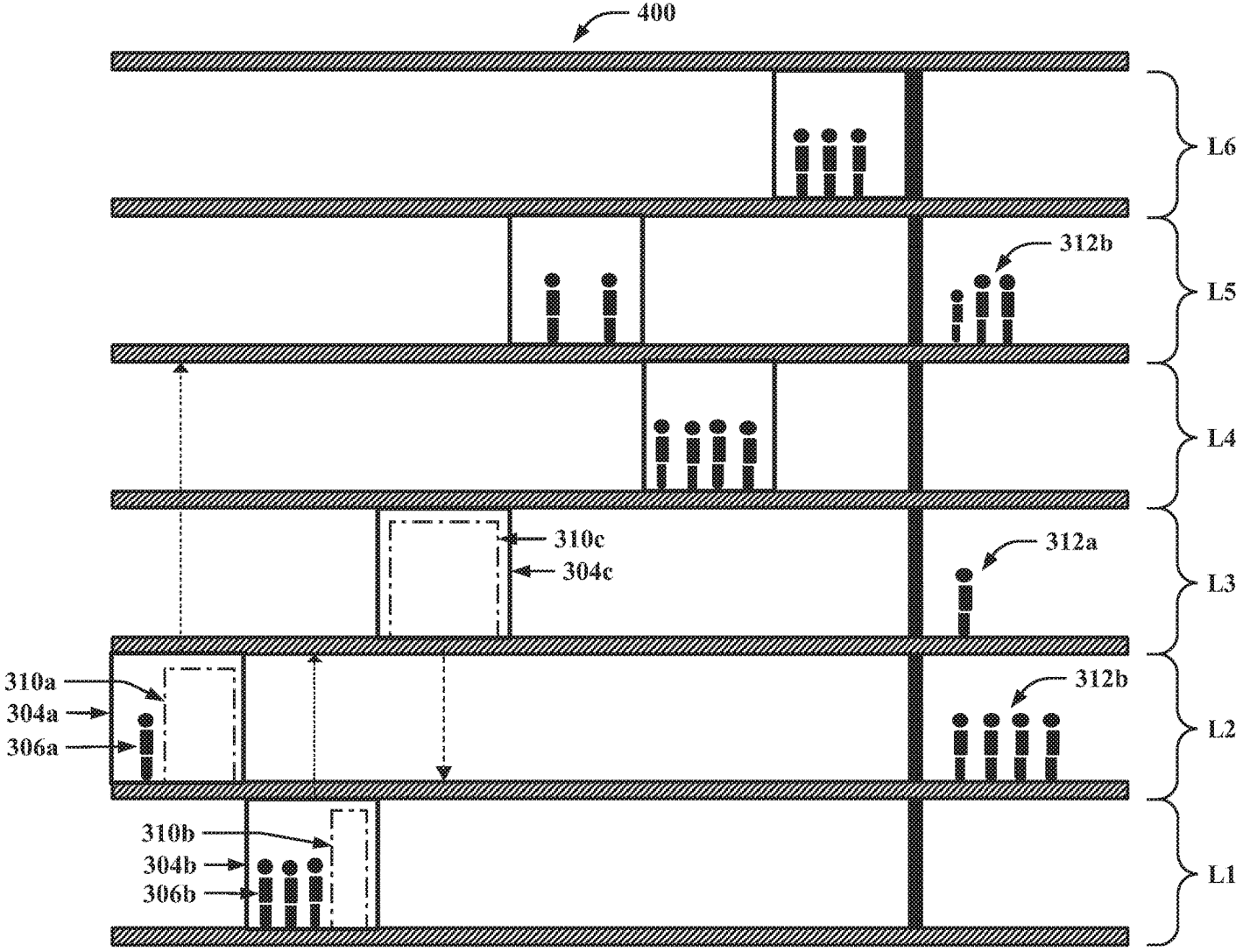
FIG. 4 illustrates a cross-sectional view of a block diagram of an example, non-limiting system that can facilitate elevator analytics and elevator optimization components in accordance with one or more embodiments described herein.

FIG. 4 illustrates a cross-sectional view of a block diagram of an example, non-limiting system 400 that can facilitate elevator analytics and elevator optimization components in accordance with one or more embodiments described herein. Repetitive description of like elements and/or processes employed in respective embodiments is omitted for sake of brevity.

In some embodiments, system 400 can comprise an environment in which the subject disclosure can be implemented in accordance with one or more embodiments described herein. For example, system 400 can comprise multiple levels of a building in which elevator analytics system 102 and/or components thereof can be implemented in accordance with one or more embodiments described herein. In some embodiments, system 400 depicted in FIG. 4 can comprise an exemplary, non-limiting embodiment of the subject disclosure that illustrates how elevator analytics system 102 and/or components thereof (e.g., arrangement component 202, assignment component 110, resource allocation component 204, etc.) can perform various operations of the subject disclosure in accordance with one or more embodiments described herein.

In some embodiments, system 400 can comprise elevator analytics system 102 (not illustrated in FIG. 4), elevators 304*a*, 304*b*, 304*c*, elevator passengers 312*a*, 312*b*, and/or one or more levels L1, L2, L3, L4, L5, L6. In some embodiments, elevators 304*a*, 304*b*, 304*c* can comprise one or more elevator passengers 306*a*, 306*b*, and/or available physical spaces 310*a*, 310*b*, 310*c*. In some embodiments, elevators 304*a*, 304*b*, 304*c* can comprise no elevator passengers or objects (e.g., elevator 304*c* depicted in FIG. 4).

In some embodiments, arrangement component 202 can determine one or more optimal spatial arrangements of elevator passengers and/or objects (e.g., as described above with reference to FIG. 2). For example, arrangement component 202 can determine an optimal spatial arrangement of elevator passenger 306*a* and available physical space 310*a* in elevator 304*a* (e.g., as depicted in FIG. 4), where elevator passengers 312*b* located on level L5 can occupy available physical space 310*a*. In another example, arrangement component 202 can determine an optimal spatial arrangement of elevator passengers 306*b* and available physical space 310*b* in elevator 304*b* (e.g., as depicted in FIG. 4), where elevator passenger 312*a* located on level L3 can occupy available physical space 310*b*. In yet another example, arrangement component 202 can determine an optimal spatial arrangement of available physical space 310*c* in elevator 304*c* (e.g., as depicted in FIG. 4), where elevator passengers 312*b* located on level L2 can occupy available physical space 310*c*.

In some embodiments, based on such optimal spatial arrangements determined by arrangement component 202 (e.g., as described above), assignment component 110 can assign elevator passengers 312*a*, 312*b* to elevators 304*a*, 304*b*, 304*c* and/or available physical spaces 310*a*, 310*b*, 310*c* as described above. For example, assignment component 110 can assign elevator passengers 312*b* located on level L5 to elevator 304*a* and/or available physical space 310*a*. In another example, assignment component 110 can assign elevator passenger 312*a* located on level L3 to elevator 304*b* and/or available physical space 310*b*. In yet another example, assignment component 110 can assign elevator passengers 312*b* located on level L2 to elevator 304*c* and/or available physical space 310*c*.

In some embodiments, based on such assignments by assignment component 110 (e.g., as described above), resource allocation component 204 can allocate (e.g., provision) elevators 304*a*, 304*b*, 304*c* to transport elevator passengers 312*a*, 312*b* and/or dispatch elevators 304*a*, 304*b*, 304*c* to levels L2, L3, L5 to collect elevator passengers 312*a*, 312*b*. For example, resource allocation component 204 can dispatch elevator 304*a* to level L5 to collect elevator passengers 312*b* located on level L5. In another example, resource allocation component 204 can dispatch elevator 304*b* to level L3 to collect elevator passenger 312*a* located on level L3. In yet another example, example, resource allocation component 204 can dispatch elevator 304*c* to level L2 to collect elevator passengers 312*b* located on level L2.

Figure 5:
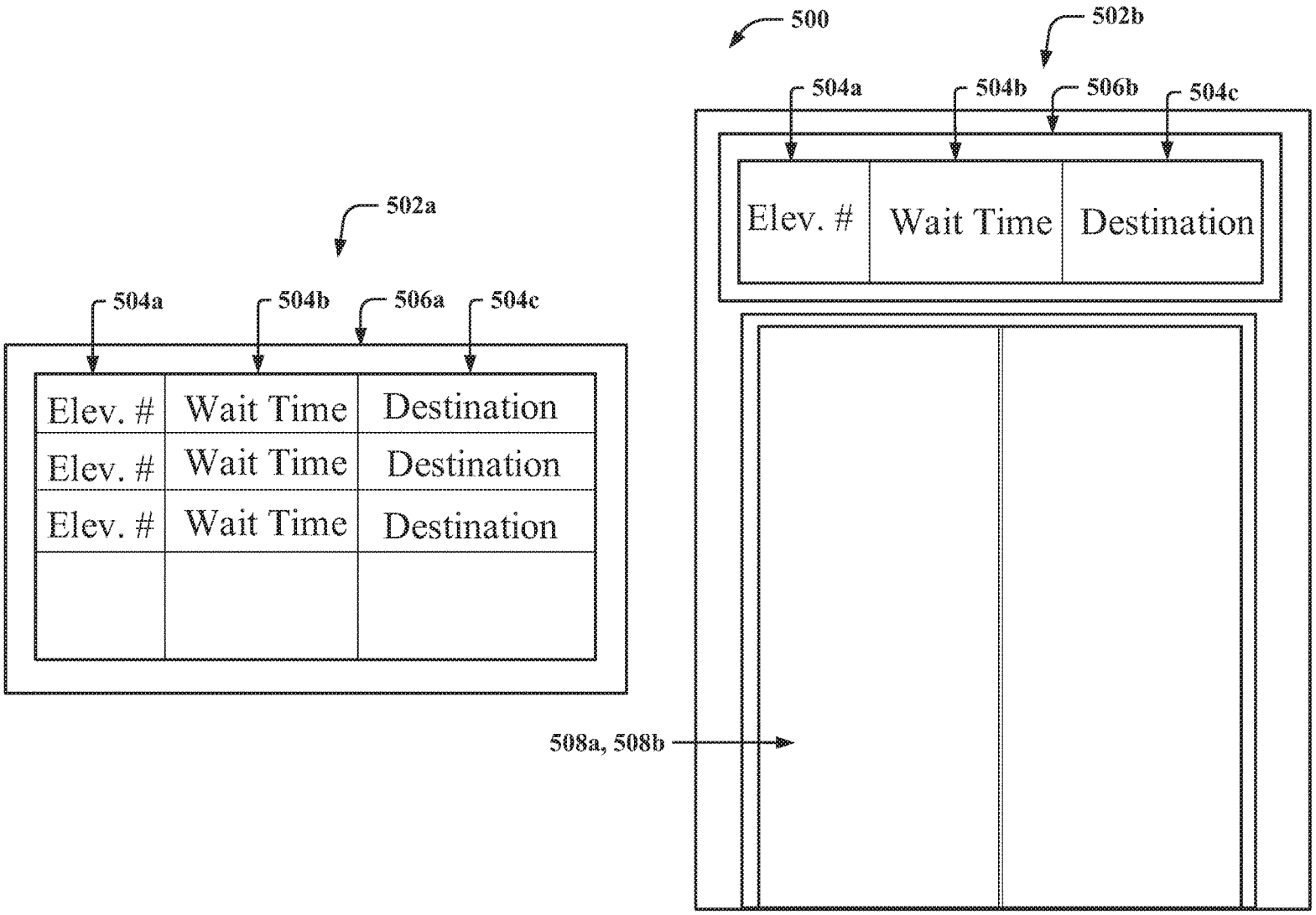
FIG. 5 illustrates a block diagram of an example, non-limiting system that can facilitate elevator analytics and elevator optimization components in accordance with one or more embodiments described herein.

FIG. 5 illustrates a block diagram of an example, non-limiting system 500 that can facilitate elevator analytics and elevator optimization components in accordance with one or more embodiments described herein. Repetitive description of like elements and/or processes employed in respective embodiments is omitted for sake of brevity.

In some embodiments, system 500 can comprise status data 502*a*, 502*b*. In some embodiments, status data 502*a*, 502*b* can respectively comprise a variety of status information corresponding to one or more resources of elevator analytics system 102. For example, status data 502*a*, 502*b* can respectively comprise status information corresponding to one or more elevators 304*a*, 304*b*, 304*c*, where such status information can include, but is not limited to, elevator number 504*a*, wait time 504*b* (e.g., elevator passenger queue duration), and/or destination 504*c* (e.g., level, story, and/or floor of a building).

In some embodiments, status data 502*a*, 502*b* can be rendered on one or more display devices 506*a*, 506*b* coupled (e.g., communicatively, electrically, operatively, etc.) to elevator analytics system 102. For example, status data 502*a*, 502*b* can be rendered on one or more display devices 506*a*, 506*b*. In some embodiments, display device 506*a* can comprise a remote device including, but not limited to, a smart phone, a wearable device, a laptop computer, a tablet, and/or another remote device. For instance, display device 506*a* can comprise remote device 314*a* of elevator passenger 312*a* illustrated in FIG. 3. In another example, display device 506*a* can comprise a screen (e.g., a monitor) of one or more elevator kiosk (e.g., elevator kiosk 324*a*, 324*b* illustrated in and described above with reference to FIG. 3). In some embodiments, display device 506*b* can comprise a screen (e.g., a monitor) positioned adjacent to (e.g., above) one or more elevator doors 508*a*, 508*b*.

Figure 6:
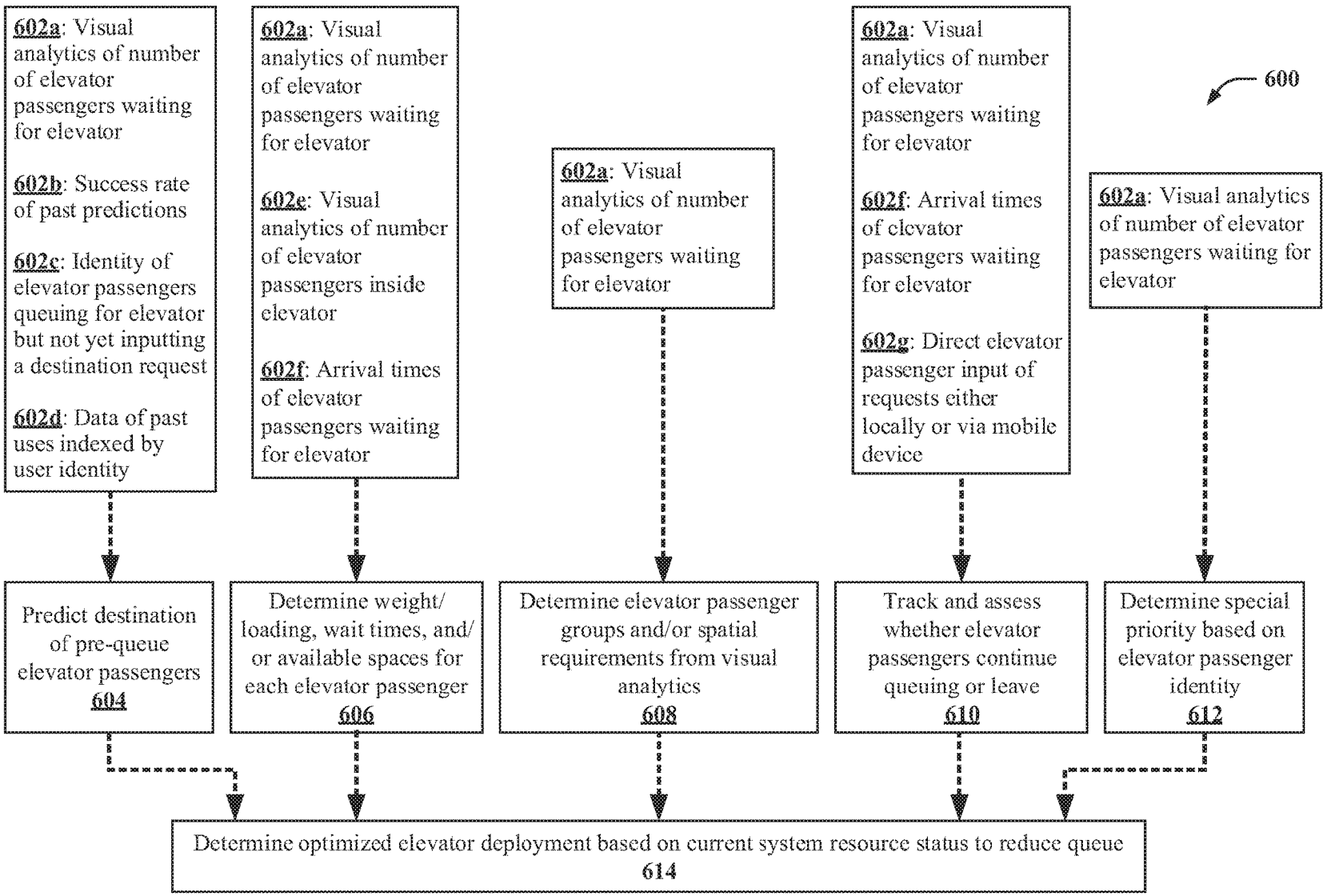
FIG. 6 illustrates a block diagram of an example, non-limiting system that can facilitate elevator analytics and elevator optimization components in accordance with one or more embodiments described herein.

FIG. 6 illustrates a block diagram of an example, non-limiting system 600 that can facilitate elevator analytics and elevator optimization components in accordance with one or more embodiments described herein. Repetitive description of like elements and/or processes employed in respective embodiments is omitted for sake of brevity.

According to multiple embodiments, system 600 can comprise one or more inputs 602*a*, 602*b*, 602*c*, 602*d*, 602*e*, 602*f*, 602*g* that can be utilized to perform one or more operations 604, 606, 608, 610, 612. In some embodiments, input 602*a* can comprise visual analytics (e.g., provided via elevator queue area cameras 316*a*, 316*b* and/or prediction component 108) of the number of elevator passengers (e.g., elevator passengers 312*a*, 312*b*, 312*c*, 312*d*) waiting for an elevator (e.g., elevators 304*a*, 304*b*, 304*c*). In some embodiments, input 602*b* can comprise a success rate of past predictions (e.g., provided by predication component 108). In some embodiments, input 602*c* can comprise the identity of elevator passengers (e.g., elevator passengers 312*a*, 312*b*, 312*c*, 312*d* and/or potential elevator passengers 322*a*, 322*b*) queuing for an elevator but not yet inputting a destination request (e.g., provided via elevator queue area cameras 316*a*, 316*b* and/or prediction component 108). In some embodiments, input 602*d* can comprise data of past uses indexed by user identity (e.g., historical elevator usage data learned by prediction component 108). In some embodiments, input 602*e* can comprise visual analytics (e.g., provided via elevator cameras 308*a*, 308*b*, 308*c* and/or prediction component 108) of the number of elevator passengers (e.g., elevator passengers 306*a*, 306*b*, 306*c*) inside an elevator (e.g., elevators 304*a*, 304*b*, 304*c*). In some embodiments, input 602*f* can comprise arrival times (e.g., provided via system optimization component 208) of elevator passengers (e.g., elevator passengers 312*a*, 312*b*, 312*c*, 312*d*) waiting for an elevator (e.g., elevators 304*a*, 304*b*, 304*c*). In some embodiments, input 602*g* can comprise direct elevator passenger input of requests either locally or via mobile device (e.g., provided via remote device 314*a* and/or elevator kiosk 324*a*, 324*b*).

In some embodiments, at operation 604, inputs 602*a*, 602*b*, 602*c*, 602*d* can be employed to predict (e.g., via prediction component 108) a destination (e.g., current destination) of pre-queue elevator passengers (e.g., elevator passengers 312*a*, 312*b*, 312*c*, 312*d* and/or potential elevator passengers 322*a*, 322*b*). In some embodiments, at operation 606, inputs 602*a*, 602*e*, 602*f* can be employed to determine (e.g., via arrangement component 202 and/or system optimization component 210) weight/loading, wait times, and/or available spaces for each elevator passenger (e.g., elevator passengers 306*a*, 306*b*, 306*c*, elevator passengers 312*a*, 312*b*, 312*c*, 312*d*, and/or potential elevator passengers 322*a*, 322*b*). In some embodiments, at operation 608, input 602*a* can be employed to determine (e.g., arrangement component 202) elevator passenger groups (e.g., elevator passengers 312*b*) and/or spatial requirements from visual analytics (e.g., provided via elevator queue area cameras 316*a*, 316*b* and/or prediction component 108). In some embodiments, at operation 610, inputs 602*a*, 602*f*, 602*g* can be employed to track and assess (e.g., via prediction component 108, system optimization component 208, and/or elevator queue area cameras 316*a*, 316*b*) whether elevator passengers (e.g., elevator passengers 312*a*, 312*b*, 312*c*, 312*d* and/or potential elevator passengers 322*a*, 322*b*) continue queuing or leave. In some embodiments, at operation 612, input 602*a* can be employed to determine (e.g., via elevator analytics system 102, resource allocation component 204, override component 206, and/or elevator queue area cameras 316*a*, 316*b*) special priority based on elevator passenger identity (e.g., company executive, a guest classified as a Very important person (VIP), potential customer, etc.).

In some embodiments, outputs of operations 604, 606, 608, 610, 612 can be provided as inputs to operation 614. For example, at operation 614, outputs of operations 604, 606, 608, 610, 612 can be provided to determine (e.g., via system optimization component 208) optimized elevator deployment based on current system resource status to reduce queue (e.g., wait time of elevator passengers 312*a*, 312*b*, 312*c*, 312*d*).

Figure 7:
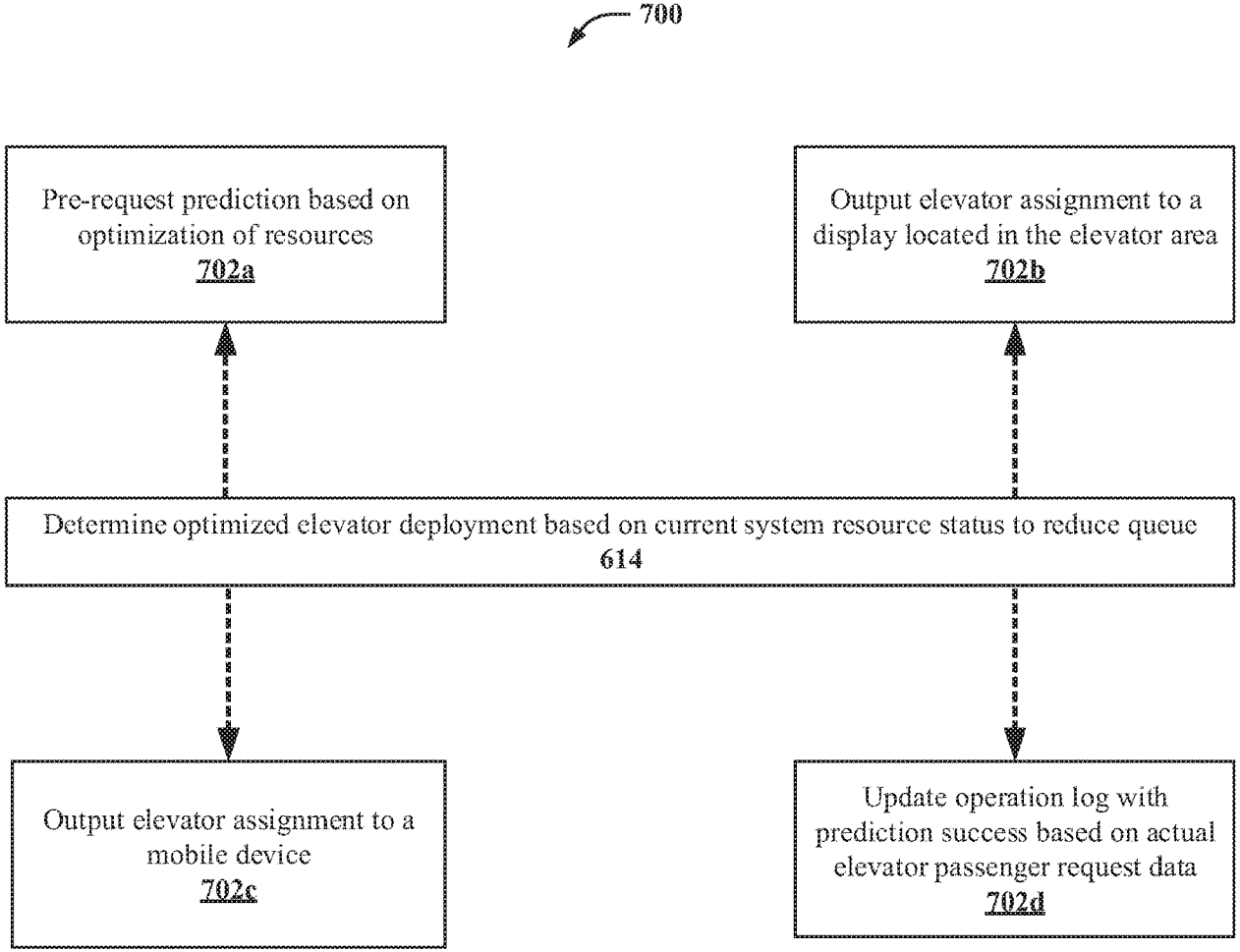
FIG. 7 illustrates a block diagram of an example, non-limiting system that can facilitate elevator analytics and elevator optimization components in accordance with one or more embodiments described herein.

FIG. 7 illustrates a block diagram of an example, non-limiting system 700 that can facilitate elevator analytics and elevator optimization components in accordance with one or more embodiments described herein. Repetitive description of like elements and/or processes employed in respective embodiments is omitted for sake of brevity.

According to multiple embodiments, system 700 can comprise output 614 and/or one or more outputs 702*a*, 702*b*, 702*c*, 702*d*. In some embodiments, outputs 702*a*, 702*b*, 702*c*, 702*d* can be generated based on output 614. In some embodiments, output 702*a* can comprise making a pre-request prediction (e.g., via prediction component 108) based on optimization of resources (e.g., via system optimization component 208). In some embodiments, output 702*b* can comprise outputting an elevator assignment to a display located in the elevator area (e.g., display device 506*b*). In some embodiments, output 702*c* can comprise outputting an elevator assignment to a mobile device (e.g., remote device 314*a* and/or display device 506*a*). In some embodiments, output 702*c* can comprise updating (e.g., via prediction component 108) an operation log (e.g., historical elevator usage index described above with reference to prediction component 108 and FIG. 1) with prediction success based on actual elevator passenger request data (e.g., historical elevator usage index described above with reference to prediction component 108 and FIG. 1).

Figure 8:
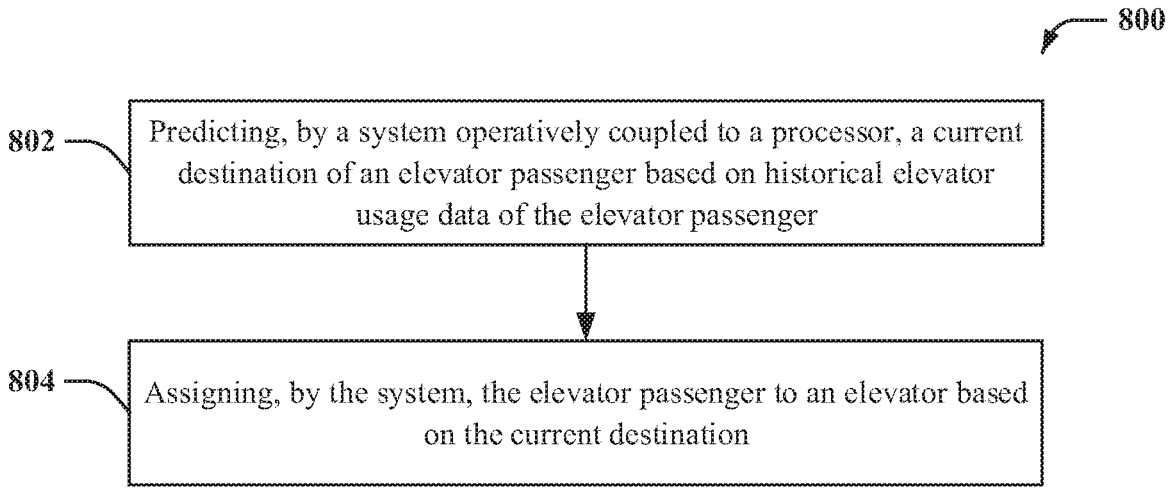
FIG. 8 illustrates a flow diagram of an example, non-limiting computer-implemented method that can facilitate elevator analytics and elevator optimization components in accordance with one or more embodiments described herein.

FIG. 8 illustrates a flow diagram of an example, non-limiting computer-implemented method 800 that can facilitate elevator analytics and elevator optimization components in accordance with one or more embodiments described herein. Repetitive description of like elements and/or processes employed in respective embodiments is omitted for sake of brevity.

At 802, predicting, by a system (e.g., elevator analytics system 102 and/or prediction component 108) operatively coupled to a processor (e.g., processor 106), a current destination (e.g., a level, story, or floor of a building) of an elevator passenger (elevator passengers 306*a*, 306*b*, 306*c*, elevator passengers 312*a*, 312*b*, 312*c*, 312*d*, and/or potential elevator passengers 322*a*, 322*b*) based on historical elevator usage data (e.g., as described above with reference to prediction component 108 and FIG. 1) of the elevator passenger. At 804, assigning, by the system (e.g., elevator analytics system 102 and/or assignment component 110), the elevator passenger to an elevator (e.g., elevators 304*a*, 304*b*, 304*c*) based on the current destination.

Figure 9:
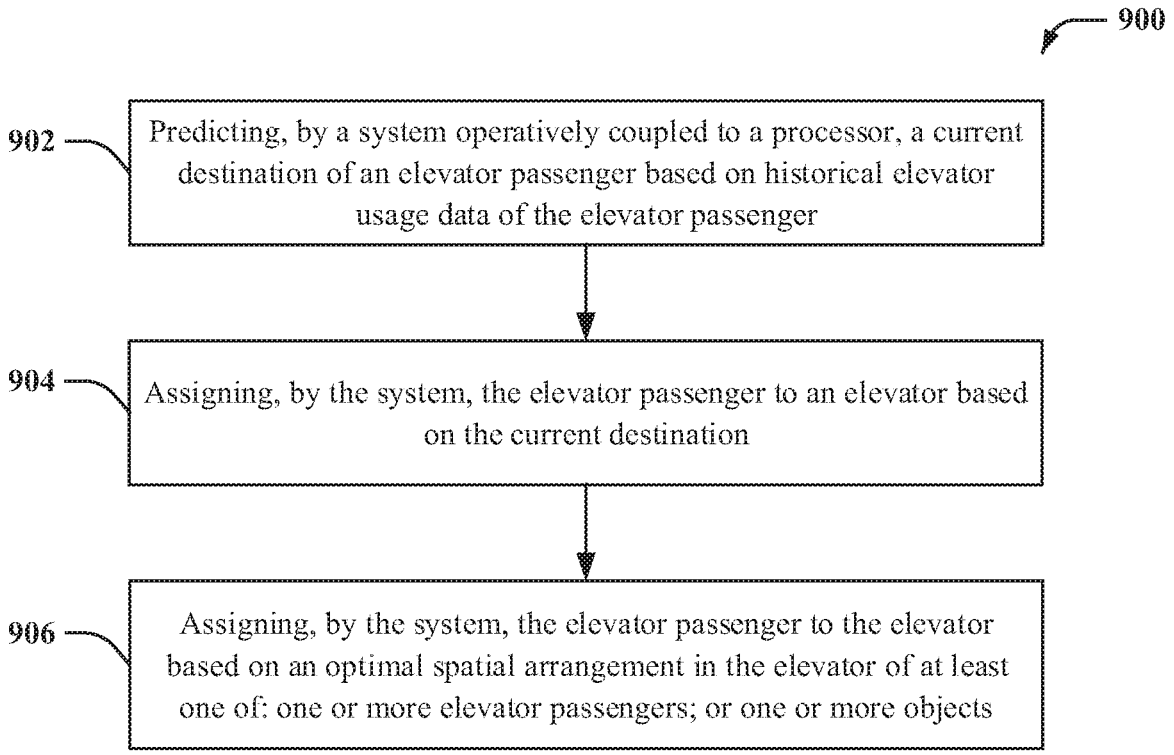
FIG. 9 illustrates a flow diagram of an example, non-limiting computer-implemented method that can facilitate elevator analytics and elevator optimization components in accordance with one or more embodiments described herein.

FIG. 9 illustrates a flow diagram of an example, non-limiting computer-implemented method 900 that can facilitate elevator analytics components in accordance with one or more embodiments described herein. Repetitive description of like elements and/or processes employed in respective embodiments is omitted for sake of brevity.

At 902, predicting, by a system (e.g., elevator analytics system 102 and/or prediction component 108) operatively coupled to a processor (e.g., processor 106), a current destination (e.g., a level, story, or floor of a building) of an elevator passenger (elevator passengers 306*a*, 306*b*, 306*c*, elevator passengers 312*a*, 312*b*, 312*c*, 312*d*, and/or potential elevator passengers 322*a*, 322*b*) based on historical elevator usage data (e.g., as described above with reference to prediction component 108 and FIG. 1) of the elevator passenger. At 904, assigning, by the system (e.g., elevator analytics system 102 and/or assignment component 110), the elevator passenger to an elevator (e.g., elevators 304*a*, 304*b*, 304*c*) based on the current destination. At 906, assigning, by the system (e.g., elevator analytics system 102 and/or assignment component 110), the elevator passenger to the elevator based on an optimal spatial arrangement (e.g., determined by arrangement component 20*s*) in the elevator of at least one of: one or more elevator passengers (e.g., elevator passengers 306*a*, 306*b*, 306*c*, elevator passengers 312*a*, 312*b*, 312*c*, 312*d*, and/or potential elevator passengers 322*a*, 322*b*); or one or more objects (e.g., remote device 314*a*, wheelchair 314*b*, stroller 314*c*, etc.).

For simplicity of explanation, the computer-implemented methodologies are depicted and described as a series of acts. It is to be understood and appreciated that the subject innovation is not limited by the acts illustrated and/or by the order of acts, for example acts can occur in various orders and/or concurrently, and with other acts not presented and described herein. Furthermore, not all illustrated acts can be required to implement the computer-implemented methodologies in accordance with the disclosed subject matter. In addition, those skilled in the art will understand and appreciate that the computer-implemented methodologies could alternatively be represented as a series of interrelated states via a state diagram or events. Additionally, it should be further appreciated that the computer-implemented methodologies disclosed hereinafter and throughout this specification are capable of being stored on an article of manufacture to facilitate transporting and transferring such computer-implemented methodologies to computers. The term article of manufacture, as used herein, is intended to encompass a computer program accessible from any computer-readable device or storage media.

Figure 10:
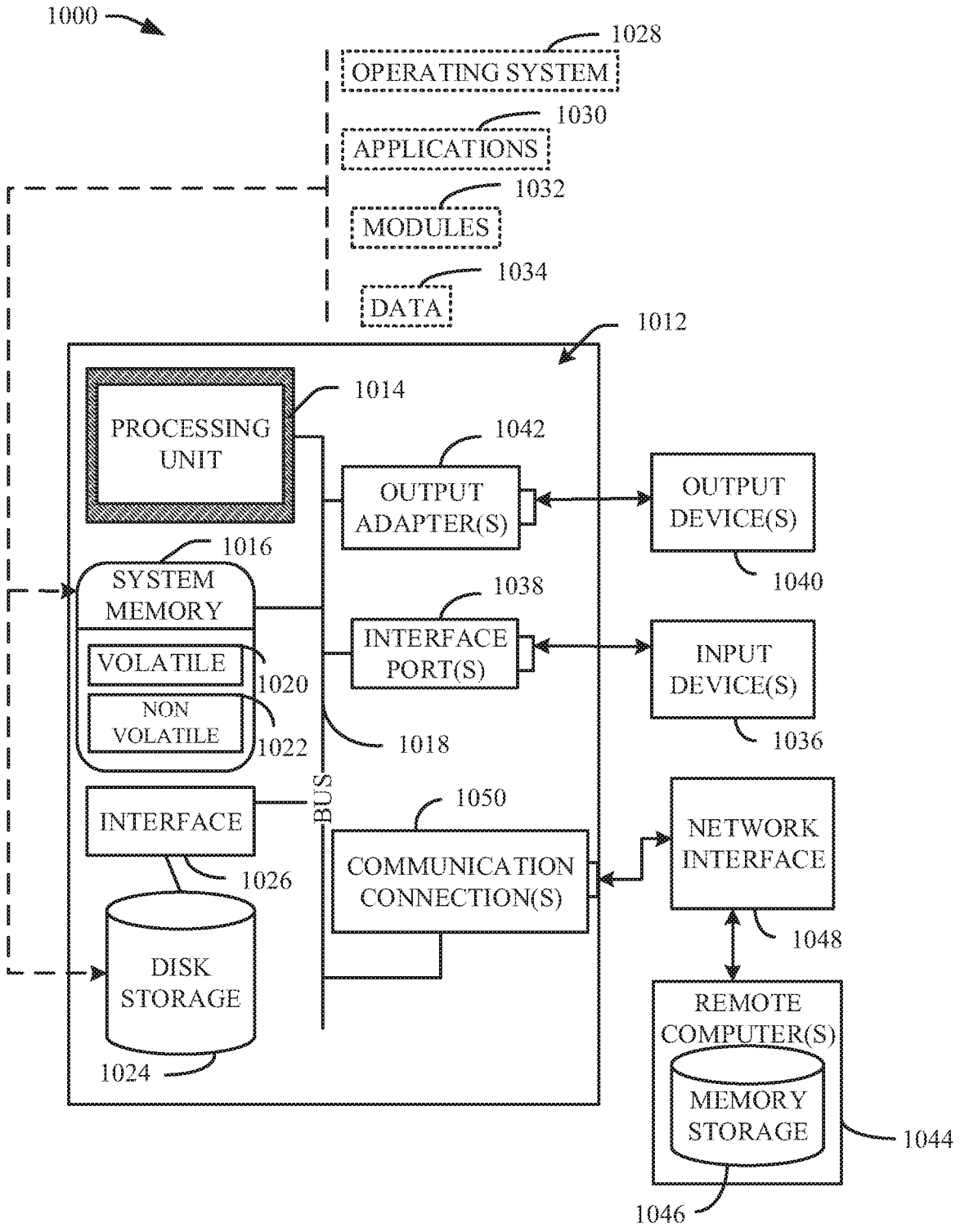
FIG. 10 illustrates a block diagram of an example, non-limiting operating environment in which one or more embodiments described herein can be facilitated.

In order to provide a context for the various aspects of the disclosed subject matter, FIG. 10 as well as the following discussion are intended to provide a general description of a suitable environment in which the various aspects of the disclosed subject matter can be implemented. FIG. 10 illustrates a block diagram of an example, non-limiting operating environment in which one or more embodiments described herein can be facilitated. Repetitive description of like elements and/or processes employed in other embodiments described herein is omitted for sake of brevity.

With reference to FIG. 10, a suitable operating environment 1000 for implementing various aspects of this disclosure can also include a computer 1012. The computer 1012 can also include a processing unit 1014, a system memory 1016, and a system bus 1018. The system bus 1018 couples system components including, but not limited to, the system memory 1016 to the processing unit 1014. The processing unit 1014 can be any of various available processors. Dual microprocessors and other multiprocessor architectures also can be employed as the processing unit 1014. The system bus 1018 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Firewire (IEEE 1394), and Small Computer Systems Interface (SCSI).

The system memory 1016 can also include volatile memory 1020 and nonvolatile memory 1022. The basic input/output system (BIOS), containing the basic routines to transfer information between elements within the computer 1012, such as during start-up, is stored in nonvolatile memory 1022. Computer 1012 can also include removable/non-removable, volatile/non-volatile computer storage media. FIG. 10 illustrates, for example, a disk storage 1024. Disk storage 1024 can also include, but is not limited to, devices like a magnetic disk drive, floppy disk drive, tape drive, Jaz drive, Zip drive, LS-100 drive, flash memory card, or memory stick. The disk storage 1024 also can include storage media separately or in combination with other storage media. To facilitate connection of the disk storage 1024 to the system bus 1018, a removable or non-removable interface is typically used, such as interface 1026. FIG. 10 also depicts software that acts as an intermediary between users and the basic computer resources described in the suitable operating environment 1000. Such software can also include, for example, an operating system 1028. Operating system 1028, which can be stored on disk storage 1024, acts to control and allocate resources of the computer 1012.

System applications 1030 take advantage of the management of resources by operating system 1028 through program modules 1032 and program data 1034, e.g., stored either in system memory 1016 or on disk storage 1024. It is to be appreciated that this disclosure can be implemented with various operating systems or combinations of operating systems. A user enters commands or information into the computer 1012 through input device(s) 1036. Input devices 1036 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1014 through the system bus 1018 via interface port(s) 1038. Interface port(s) 1038 include, for example, a serial port, a parallel port, a game port, and a universal serial bus (USB). Output device(s) 1040 use some of the same type of ports as input device(s) 1036. Thus, for example, a USB port can be used to provide input to computer 1012, and to output information from computer 1012 to an output device 1040. Output adapter 1042 is provided to illustrate that there are some output devices 1040 like monitors, speakers, and printers, among other output devices 1040, which require special adapters. The output adapters 1042 include, by way of illustration and not limitation, video and sound cards that provide a means of connection between the output device 1040 and the system bus 1018. It should be noted that other devices and/or systems of devices provide both input and output capabilities such as remote computer(s) 1044.

Computer 1012 can operate in a networked environment using logical connections to one or more remote computers, such as remote computer(s) 1044. The remote computer(s) 1044 can be a computer, a server, a router, a network PC, a workstation, a microprocessor based appliance, a peer device or other common network node and the like, and typically can also include many or all of the elements described relative to computer 1012. For purposes of brevity, only a memory storage device 1046 is illustrated with remote computer(s) 1044. Remote computer(s) 1044 is logically connected to computer 1012 through a network interface 1048 and then physically connected via communication connection 1050. Network interface 1048 encompasses wire and/or wireless communication networks such as local-area networks (LAN), wide-area networks (WAN), cellular networks, etc. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL). Communication connection(s) 1050 refers to the hardware/software employed to connect the network interface 1048 to the system bus 1018. While communication connection 1050 is shown for illustrative clarity inside computer 1012, it can also be external to computer 1012. The hardware/software for connection to the network interface 1048 can also include, for exemplary purposes only, internal and external technologies such as, modems including regular telephone grade modems, cable modems and DSL modems, ISDN adapters, and Ethernet cards.

Figure 11:
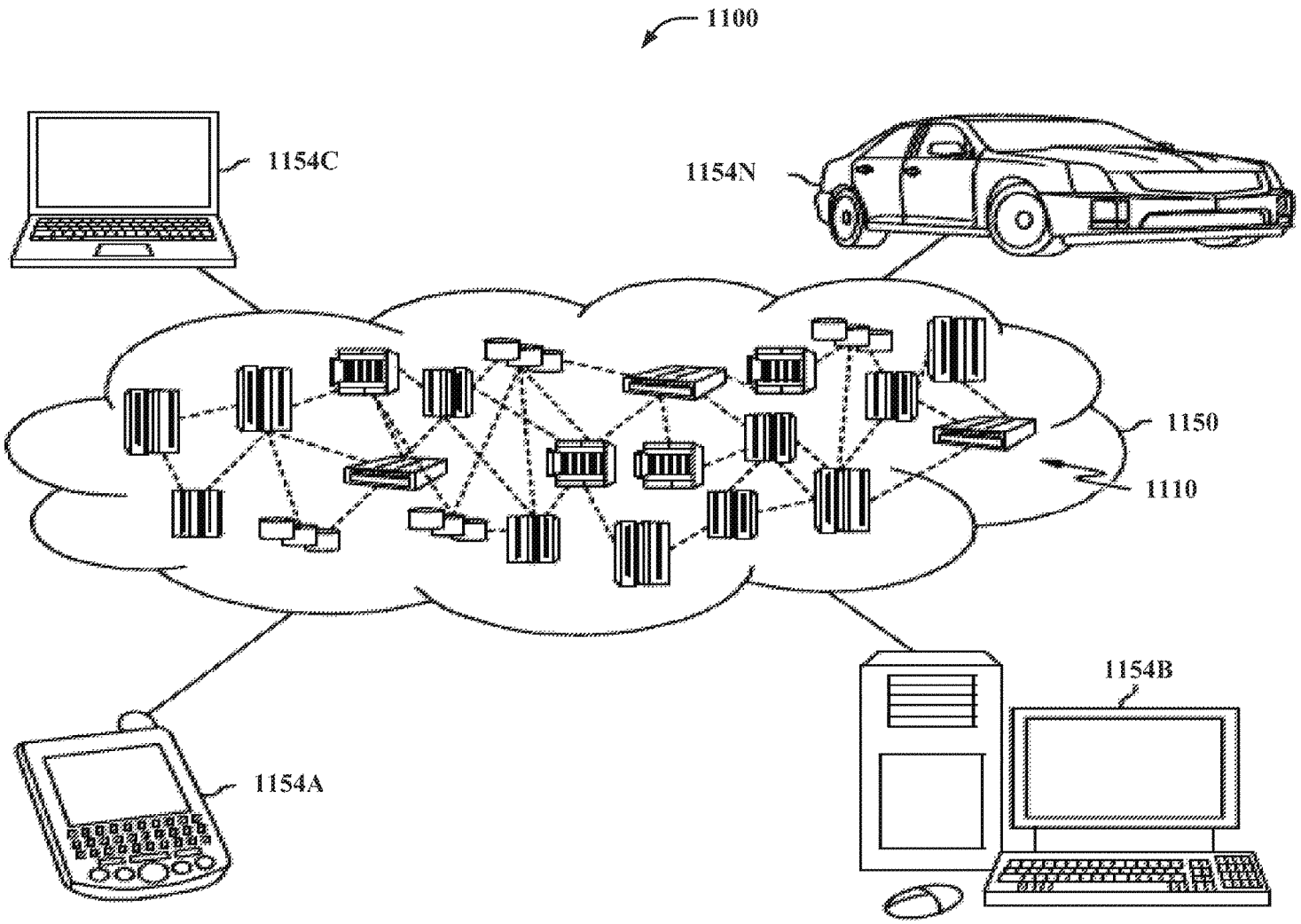
FIG. 11 illustrates a block diagram of an example, non-limiting cloud computing environment in accordance with one or more embodiments of the subject disclosure.

Referring now to FIG. 11, an illustrative cloud computing environment 1150 is depicted. As shown, cloud computing environment 1150 includes one or more cloud computing nodes 1110 with which local computing devices used by cloud consumers, such as, for example, personal digital assistant (PDA) or cellular telephone 1154A, desktop computer 1154B, laptop computer 1154C, and/or automobile computer system 1154N may communicate. Nodes 1110 may communicate with one another. They may be grouped (not shown) physically or virtually, in one or more networks, such as Private, Community, Public, or Hybrid clouds as described hereinabove, or a combination thereof. This allows cloud computing environment 1150 to offer infrastructure, platforms and/or software as services for which a cloud consumer does not need to maintain resources on a local computing device. It is understood that the types of computing devices 1154A-N shown in FIG. 11 are intended to be illustrative only and that computing nodes 1110 and cloud computing environment 1150 can communicate with any type of computerized device over any type of network and/or network addressable connection (e.g., using a web browser).

Figure 12:
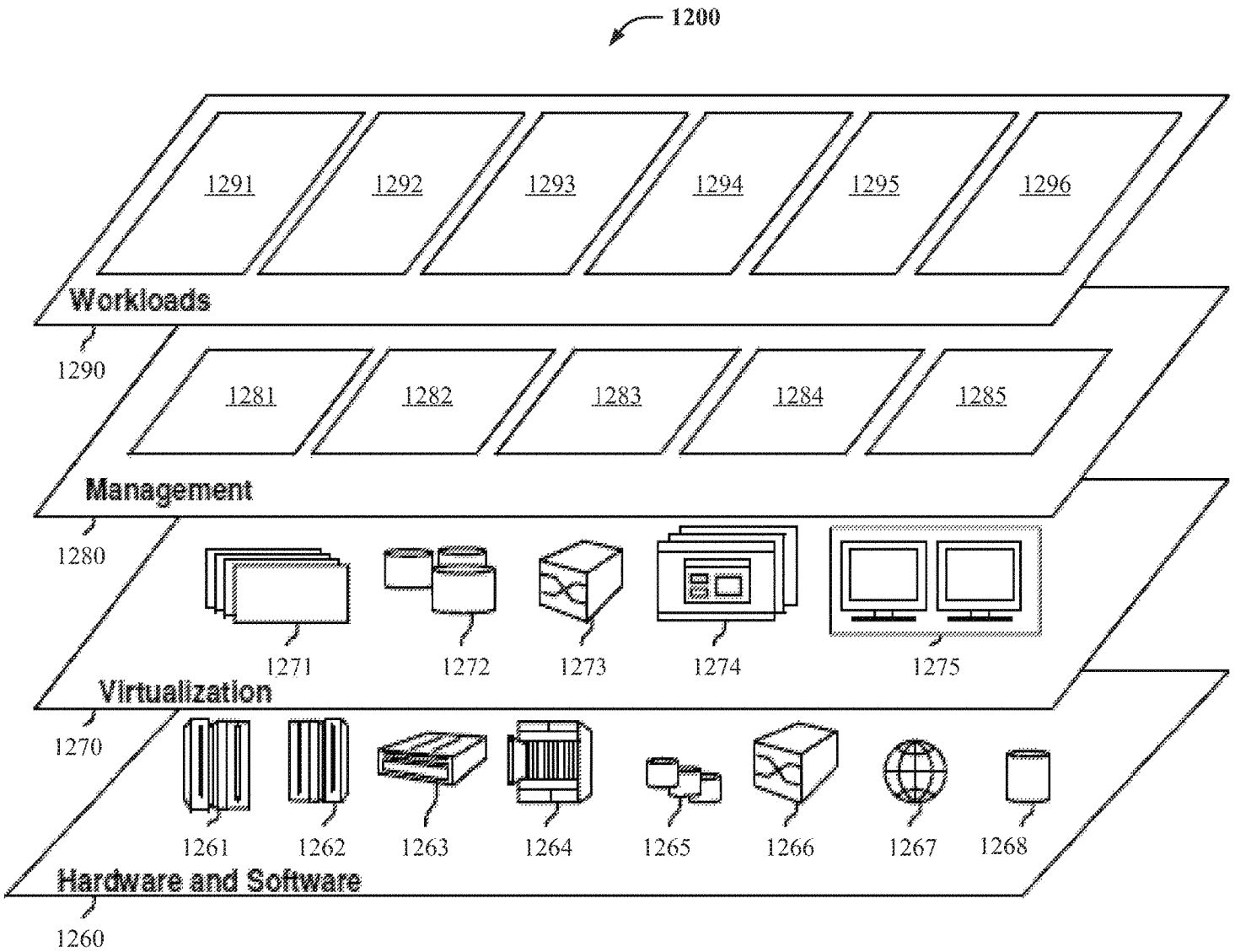
FIG. 12 illustrates a block diagram of example, non-limiting abstraction model layers in accordance with one or more embodiments of the subject disclosure.

Referring now to FIG. 12, a set of functional abstraction layers provided by cloud computing environment 1150 (FIG. 11) is shown. It should be understood in advance that the components, layers, and functions shown in FIG. 12 are intended to be illustrative only and embodiments of the invention are not limited thereto. As depicted, the following layers and corresponding functions are provided:

Hardware and software layer 1260 includes hardware and software components. Examples of hardware components include: mainframes 1261; RISC (Reduced Instruction Set Computer) architecture based servers 1262; servers 1263; blade servers 1264; storage devices 1265; and networks and networking components 1266. In some embodiments, software components include network application server software 1267 and database software 1268.

Virtualization layer 1270 provides an abstraction layer from which the following examples of virtual entities may be provided: virtual servers 1271; virtual storage 1272; virtual networks 1273, including virtual private networks; virtual applications and operating systems 1274; and virtual clients 1275.

In one example, management layer 1280 may provide the functions described below. Resource provisioning 1281 provides dynamic procurement of computing resources and other resources that are utilized to perform tasks within the cloud computing environment. Metering and Pricing 1282 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 1283 provides access to the cloud computing environment for consumers and system administrators. Service level management 1284 provides cloud computing resource allocation and management such that required service levels are met. Service Level Agreement (SLA) planning and fulfillment 1285 provide pre-arrangement for, and procurement of, cloud computing resources for which a future requirement is anticipated in accordance with an SLA.

Workloads layer 1290 provides examples of functionality for which the cloud computing environment may be utilized. Non-limiting examples of workloads and functions which may be provided from this layer include: mapping and navigation 1291; software development and lifecycle management 1292; virtual classroom education delivery 1293; data analytics processing 1294; transaction processing 1295; and elevator analytics software 1296.

The present invention may be a system, a method, an apparatus and/or a computer program product at any possible technical detail level of integration. The computer program product can include a computer readable storage medium (or media) having computer readable program instructions thereon for causing a processor to carry out aspects of the present invention. The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium can also include the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of the present invention can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions. These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions can also be loaded onto a computer, other programmable data processing apparatus, or other device to cause a series of operational acts to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams can represent a module, segment, or portion of instructions, which comprises one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the subject matter has been described above in the general context of computer-executable instructions of a computer program product that runs on a computer and/or computers, those skilled in the art will recognize that this disclosure also can or can be implemented in combination with other program modules. Generally, program modules include routines, programs, components, data structures, etc. that perform particular tasks and/or implement particular abstract data types. Moreover, those skilled in the art will appreciate that the inventive computer-implemented methods can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated aspects can also be practiced in distributed computing environments in which tasks are performed by remote processing devices that are linked through a communications network. However, some, if not all aspects of this disclosure can be practiced on stand-alone computers. In a distributed computing environment, program modules can be located in both local and remote memory storage devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," "data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system, comprising:

a memory that stores computer executable components; and a processor that executes the computer executable components stored in the memory, wherein the computer executable components comprise:

a prediction component that:

identifies, using a device that captures data associated with elevator passengers, an elevator passenger in a defined area associated with a group of elevators based upon at least one feature of the elevator passenger in the data, assigns a priority to the elevator passenger based on a feature of the at least one feature of the elevator passenger, wherein the feature comprises a personal characteristic of the elevator passenger, and predicts a current destination of the elevator passenger based on historical elevator usage data of the elevator passenger; and an assignment component that assigns the elevator passenger to an elevator selected from the group of elevators based on the current destination and the priority of the elevator passenger.

2. The system of claim 1, wherein the assignment component further assigns the elevator passenger to the elevator based on an optimal spatial arrangement in the elevator of at least one of: one or more elevator passengers; or one or more objects.

3. The system of claim 1, wherein the computer executable components further comprise:

an arrangement component that determines an optimal spatial arrangement in the elevator of at least one of: one or more elevator passengers; or one or more objects.

4. The system of claim 3, wherein the arrangement component determines the optimal spatial arrangement based on current elevator passenger data comprising visual data of at least one of: a first elevator passenger inside the elevator; a first object inside the elevator; a second elevator passenger outside the elevator; or a second object outside the elevator.

5. The system of claim 1, wherein the assignment component further assigns the elevator passenger to the elevator based on detection of a remote device of the elevator passenger.

6. The system of claim 1, wherein the prediction component further tracks one or more destinations of the elevator passenger to predict a second current destination.

7. The system of claim 1, wherein the computer executable components further comprise:

a resource allocation component that allocates one or more elevators based on at least one of: the historical elevator usage data; the current destination; current elevator passenger data; or an optimal spatial arrangement in the one or more elevators.

8. The system of claim 1, wherein the computer executable components further comprise:

an override component that overrides an assignment of the elevator passenger to the elevator based on at least one of: a security rule; an administrative rule; a medical rule; an emergency rule; or an identification of a defined second elevator passenger.

9. The system of claim 1, wherein the computer executable components further comprise:

a system optimization component that evaluates status of one or more resources of the system and executes one or more operations to optimize at least one of deployment of one or more elevators or elevator queue duration, thereby facilitating at least one of: improved processing efficiency of the processor; or reduced power consumption by the system.

10. A computer-implemented method, comprising:

identifying, by a system operatively coupled to a processor, using a device that captures data associated with elevator passengers, an elevator passenger in a defined area associated with a group of elevators based upon at least one feature of the elevator passenger in the data;

assigning, by the system, a priority to the elevator passenger based on a feature of the at least one feature of the elevator passenger, wherein the feature comprises a personal characteristic of the elevator passenger;

predicting, by a system operatively coupled to a processor, a current destination of the elevator passenger based on historical elevator usage data of the elevator passenger; and assigning, by the system, the elevator passenger to an elevator selected from the group of elevators based on the current destination and the priority of the elevator passenger.

11. The computer-implemented method of claim 10, further comprising:

assigning, by the system, the elevator passenger to the elevator based on an optimal spatial arrangement in the elevator of at least one of: one or more elevator passengers; or one or more objects.

12. The computer-implemented method of claim 10, further comprising:

determining, by the system, an optimal spatial arrangement in the elevator of at least one of: one or more elevator passengers; or one or more objects.

13. The computer-implemented method of claim 10, further comprising:

assigning, by the system, the elevator passenger to the elevator based on detection of a remote device of the elevator passenger, thereby facilitating a reduced queue duration of the elevator passenger.

14. The computer-implemented method of claim 10, further comprising:

tracking, by the system, one or more destinations of the elevator passenger.

15. The computer-implemented method of claim 10, further comprising:

allocating, by the system, one or more elevators based on at least one of: the historical elevator usage data; the current destination; current elevator passenger data; or an optimal spatial arrangement in the one or more elevators.

16. The computer-implemented method of claim 10, further comprising:

overriding, by the system, an assignment of the elevator passenger to the elevator based on at least one of: a security rule; an administrative rule; a medical rule; an emergency rule; or an identification of a defined second elevator passenger.

17. A computer program product facilitating an elevator analytics and/or elevator optimization process, the computer program product comprising a computer readable storage medium having program instructions embodied therewith, the program instructions executable by a processor to cause the processor to:

identify, by the processor, using a device that captures data associated with elevator passengers, an elevator passenger in a defined area associated with a group of elevators based upon at least one feature of the elevator passenger in the data;

assign, by the processor, a priority to the elevator passenger based on a feature of the at least one feature of the elevator passenger, wherein the feature comprises a personal characteristic of the elevator passenger;

predict, by the processor, a current destination of the elevator passenger based on historical elevator usage data of the elevator passenger; and assign, by the processor, the elevator passenger to an elevator selected from the group of elevators based on the current destination and the priority of the elevator passenger.

18. The computer program product of claim 17, wherein the program instructions are further executable by the processor to cause the processor to:

assign, by the processor, the elevator passenger to the elevator based on an optimal spatial arrangement in the elevator of at least one of: one or more elevator passengers; or one or more objects.

19. The computer program product of claim 17, wherein the program instructions are further executable by the processor to cause the processor to:

allocate, by the processor, one or more elevators based on at least one of: the historical elevator usage data; the current destination; current elevator passenger data; an optimal spatial arrangement in the one or more elevators; or detection of a remote device of the elevator passenger.

20. The computer program product of claim 17, wherein the program instructions are further executable by the processor to cause the processor to:

override, by the processor, an assignment of the elevator passenger to the elevator based on at least one of: a security rule; an administrative rule; a medical rule; an emergency rule; or an identification of a defined second elevator passenger.

* * * * *